US006742483B2

(12) United States Patent
Asakura

(10) Patent No.: US 6,742,483 B2
(45) Date of Patent: Jun. 1, 2004

(54) ASSISTING DEVICE AND METHOD FOR VARIABLE VALVE MECHANISM

(75) Inventor: Ken Asakura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/274,402

(22) Filed: Oct. 21, 2002

(65) Prior Publication Data

US 2003/0075126 A1 Apr. 24, 2003

(30) Foreign Application Priority Data

Oct. 23, 2001 (JP) ..... 2001-324757

(51) Int. Cl.[7] ..... F01L 1/34

(52) U.S. Cl. ..... 123/90.16; 123/90.18; 123/90.39; 123/90.2; 123/90.44

(58) Field of Search ..... 123/90.15, 90.16, 123/90.17, 90.18, 90.2, 90.21, 90.22, 90.39, 90.4, 90.44, 90.45, 90.46

(56) References Cited

U.S. PATENT DOCUMENTS 5,289,806 A * 3/1994 Hurr ..... 123/90.17
5,445,117 A * 8/1995 Mendler ..... 123/90.16
5,497,737 A * 3/1996 Nakamura ..... 123/90.15
6,105,551 A 8/2000 Nakano et al.
6,182,623 B1 * 2/2001 Sugie et al. ..... 123/90.17
6,244,230 B1 6/2001 Mikame
6,318,313 B1 * 11/2001 Moriya et al. ..... 123/90.15

FOREIGN PATENT DOCUMENTS

JP A 2000-54814 2/2000

* cited by examiner

*Primary Examiner*—Thomas Denion
*Assistant Examiner*—Ching Chang
(74) *Attorney, Agent, or Firm*—Oliff & Berridge PLC

(57) ABSTRACT

An output from each of output rods is converted into an assisting force via a corresponding one of rollers, while an outer peripheral surface of each of the rollers moving together with a control shaft serves as a conversion plane. This output is applied to the control shaft. Hence, as the control shaft is moved in such a direction as to increase valve lift amounts of intake valves, the assisting force can be correspondingly increased. Thus, a suitable assisting force that can act against a thrust force can be applied to the control shaft. As a result, there is no apprehension that a minimum hydraulic fluid pressure will not be ensured on the side of a larger valve lift amount or that responding properties in movements of the control shaft will deteriorate.

23 Claims, 20 Drawing Sheets

ASSISTING DEVICE AND METHOD FOR VARIABLE VALVE MECHANISM

INCORPORATION BY REFERENCE

The disclosure of Japanese Patent Application No. 2001-324757 filed on Oct. 23, 2001, including the specification, drawings, and abstract is incorporated herein by reference in its entirety.

BACKGROUND OF THE INVENTION

1. Field of Invention

The invention relates to an assisting device and method for a variable valve mechanism. More particularly, the invention relates to an assisting device for applying an assisting force acting against a thrust force generated in a control shaft to a variable valve mechanism that allows valve lift amounts to continuously change in such a manner as to interlock with an axial position of the control shaft by axially moving the control shaft.

2. Description of Related Art

As a related art, there is known a variable valve mechanism in which a cam shaft having three-dimensional cams whose cam noses (surfaces) gradually increase in height along an axial direction is moved in the axial direction so as to continuously adjust valve lift amounts of intake valves of an internal combustion engine in accordance with an operational state thereof (Japanese Patent Application Laid-Open No. 2000-54814).

In a variable valve mechanism in which a cam shaft is thus axially moved to allow valve lift amounts to continuously change, a thrust force is generated in such a direction as to reduce the valve lift amounts due to an axial inclination of cam surfaces of three-dimensional cams. Moreover, as the valve lift amounts are increased, compression strokes of valve springs are increased, which leads to a gradual increase in restoring forces thereof. As a result, the aforementioned thrust force is increased as well.

In the case where such a variable valve mechanism is utilized to regulate the amount of intake air in an internal combustion engine by adjusting valve lift amounts of intake valves instead of adjusting a throttle valve, an actuator for axially moving a cam shaft is required to have high responding properties. Especially in the case where a hydraulic actuator is employed, in order to accomplish high responding properties, it is required that the flow rate of a hydraulic fluid be reduced by reducing the diameter of pistons. However, if the diameter of the pistons is reduced, the actuator output cannot be adapted for an increase in the aforementioned thrust force, which causes an apprehension that a minimum hydraulic fluid pressure will not be generated or that the responding properties will deteriorate.

In order to address these problems, one might consider providing an assisting spring for assisting the operation of the actuator by generating an assisting force that acts against the aforementioned thrust force. However, as described above, while the thrust force is increased in proportion to an increase in the valve lift amounts, the restoring force of the assisting spring is reduced as the cam shaft is shifted to the high-lift side. Hence, this restoring force is inadequate as an assisting force.

Such a problem is caused in other types of variable valve mechanisms in which valve lift amounts can continuously change due to axial movements of a control shaft, as well as in a variable valve mechanism employing three-dimensional cams.

SUMMARY OF THE INVENTION

It is an object of the invention to provide an assisting device capable of applying a suitable assisting force to a variable valve mechanism that allows valve lift amounts to continuously change with changes in an axial position of a control shaft by axially moving the control shaft.

In order to achieve the aforementioned and/or other objects, an assisting device for applying an assisting force to counteract a thrust force generated in a variable valve mechanism according to one aspect of the invention comprises valves disposed in the variable valve mechanism, a control shaft for allowing valve lift amounts of the valves to continuously change with changes in an axial position of the control shaft, the control shaft receiving the thrust force from the valves, and an assisting force applying portion for generating and applying the assisting force on the basis of a restoring force of an elastic body or a pressure of a fluid and increasing the assisting force as the axial position of the control shaft is shifted to a high-lift side.

This structure allows a suitable assisting force capable of acting against a thrust force that is increased as the axial position of the control shaft is shifted to the high-lift side to be applied to the variable valve mechanism.

BRIEF DESCRIPTION OF THE DRAWINGS

The invention will be described with reference to exemplary embodiments illustrated in the drawings, in which.

DETAILED DESCRIPTION OF PREFERRED EMBODIMENTS

Figure 1:
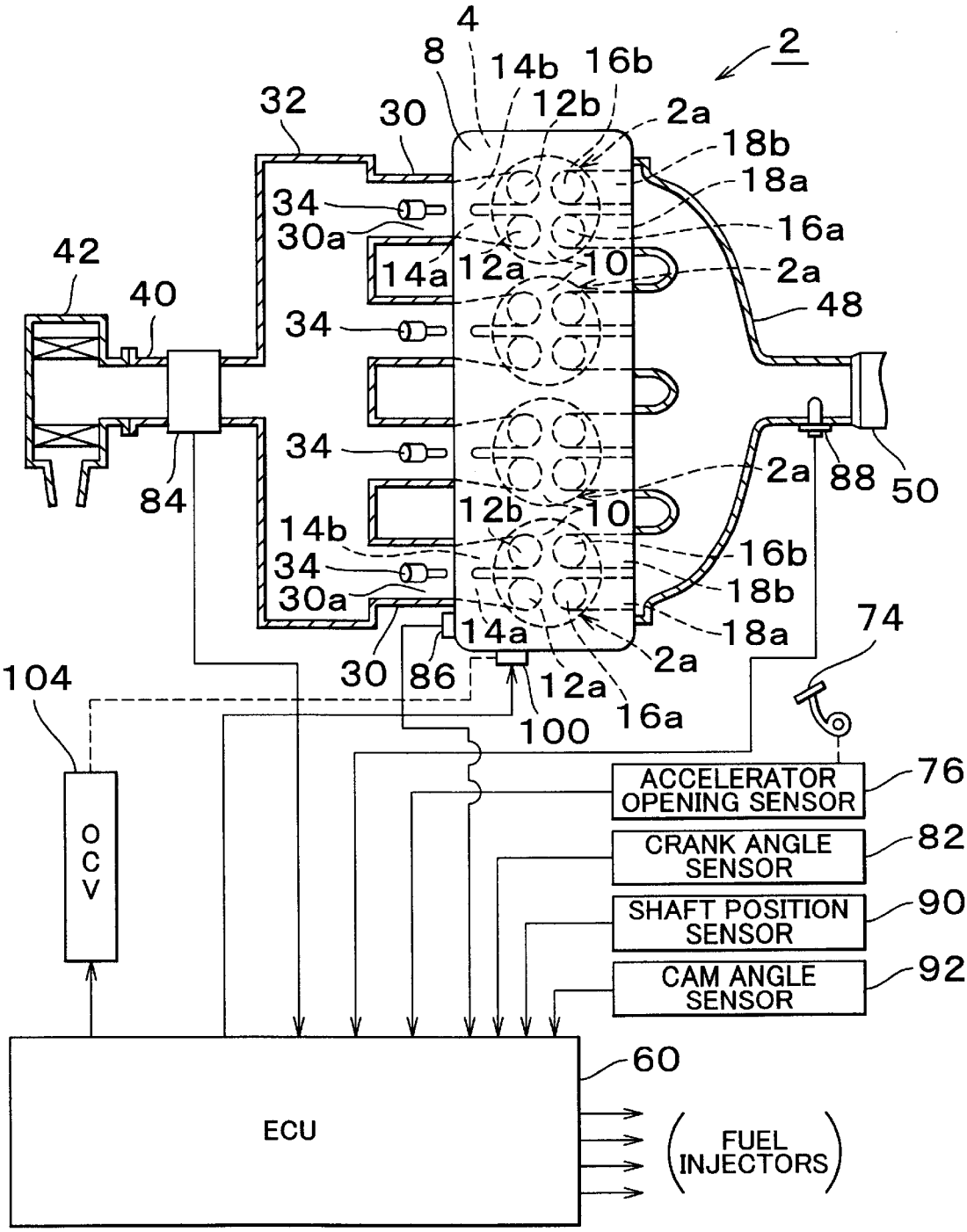
FIG. 1 is a block diagram showing the overall structure of an engine equipped with an assisting device and a variable valve mechanism according to a first embodiment of the invention and a control system for the engine.

FIG. 1 is a block diagram of the overall structure of a gasoline engine (hereinafter referred to as the "engine") 2 as an internal combustion engine equipped with an assisting device and a variable valve mechanism to which the aforementioned invention is applied, and of a control system for the engine 2.

The engine 2 is installed in an automobile as a drive source for causing the automobile to run. The engine 2 includes a cylinder block 4, pistons (not shown), a cylinder head 8 mounted on the cylinder block 4, and the like. A plurality of cylinders are formed in the cylinder block 4. For example, in this case, four cylinders 2*a* are formed in the cylinder block 4. Each of the cylinders 2*a* has a corresponding one of combustion chambers 10, each of which is defined by the cylinder block 4, a corresponding one of the pistons, and the cylinder head 8. In each of the combustion chambers 10, four valves, namely, a corresponding one of first intake valves 12*a*, a corresponding one of second intake valves 12*b*, a corresponding one of first exhaust valves 16*a*, and a corresponding one of second exhaust valves 16*b* are disposed. Each of the first intake valves 12*a* opens and closes a corresponding one of first intake ports 14*a*. Each of the second intake valves 12*b* opens and closes a corresponding one of second intake ports 14*b*. Each of the first exhaust valves 16*a* opens and closes a corresponding one of first exhaust ports 18*a*. Each of the second exhaust valves 16*b* opens and closes a corresponding one of second exhaust ports 18*b*.

The first intake port 14*a* and the second intake port 14*b* of each of the cylinders 2*a* are connected to a surge tank 32 via a corresponding one of intake passages 30*a* formed in an intake manifold 30. Disposed in each of the intake passages 30*a* is a corresponding one of fuel injectors 34, which makes it possible to inject fuel into corresponding ones of the first intake ports 14*a* and the second intake ports 14*b*.

The surge tank 32 is coupled to an air cleaner 42 via an intake duct 40. It is to be noted herein that there is no throttle valve disposed in the intake duct 40. An operation of an accelerator pedal 74 and an intake air amount control corresponding to an engine speed NE during an idle speed control are performed by adjusting valve lift amounts of the first intake valves 12*a* and of the second intake valves 12*b*.

Figure 2:
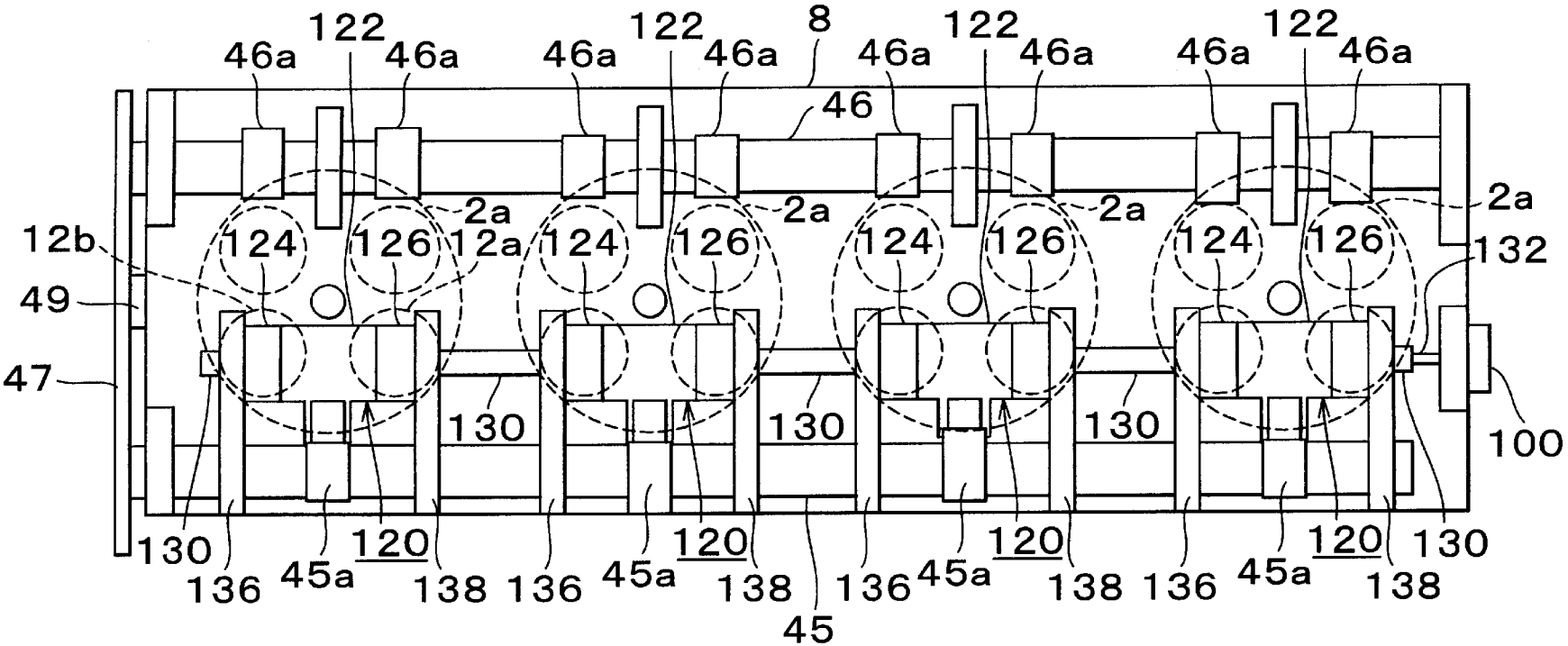
FIG. 2 is an explanatory view of the structure of a cylinder head portion of the engine.

Lifting movements of intake cams 45*a* on an intake cam shaft 45 are transmitted via a corresponding one of later-described intermediary drive mechanisms 120 disposed in the cylinder head 8 as shown in FIG. 2, whereby it becomes possible to drive the intake valves 12*a*, 12*b*. In this transmission, a transmission state of lift by the intermediary drive mechanism 120 is adjusted through a function of a later-described slide actuator 100, whereby the valve lift amounts are adjusted. The intake cam shaft 45 is interlocked with rotation of a crank shaft 49 of the engine 2 via a timing chain 47 and a timing sprocket (which may be replaced with a timing gear or a timing pulley) disposed at one end of the intake cam shaft 45.

As shown in FIG. 1, each of the first exhaust valves 16*a* for opening and closing a corresponding one of the first exhaust ports 18*a* of a corresponding one of the cylinders 2*a* and each of the second exhaust valves 16*b* for opening and closing a corresponding one of the second exhaust ports 18*b* of a corresponding one of the cylinders 2*a* are opened and closed by a certain valve lift amount through rotation of exhaust cams 46*a* (FIG. 2) on an exhaust cam shaft 46 (FIG. 2) resulting from rotation of the engine 2. The first exhaust port 18*a* and the second exhaust port 18*b* of each of the cylinders 2*a* are coupled to an exhaust manifold 48. Thus, exhaust gas is discharged to the outside via a catalytic converter 50.

An electronic control unit (hereinafter referred to as the ECU) 60 is constructed of a digital computer and includes components such as a CPU, a ROM, a RAM, various driver circuits, input ports, and output ports, which are interconnected via a bidirectional bus.

Various output voltages and various pulses are input to the input ports of the ECU 60. The various output voltages include an output voltage proportional to a depression stroke of the accelerator pedal 74 as an output from an accelerator opening sensor 76 (hereinafter referred to as an "accelerator opening ACCP"), an output voltage corresponding to an amount GA of intake air flowing through the intake duct 40 as an output from an intake air amount sensor 84, an output voltage corresponding to a coolant temperature THW of the engine 2 as an output from a coolant temperature sensor 86 disposed in the cylinder block 4 of the engine 2, an output voltage corresponding to an air-fuel ratio as an output from an air-fuel ratio sensor 88 disposed in the exhaust manifold 48, and an output voltage corresponding to an axial displacement as an output from a shaft position sensor 90 for detecting an axial moving distance of a later-described control shaft 132 that is moved by the slide actuator 100.

The various pulses include a pulse that is output by a crank angle sensor 82 every time the crank shaft rotates by 30° and a pulse output from a cam angle sensor 92 for detecting cam angles of the intake cams 45*a* for driving the intake valves 12*a*, 12*b* via the intermediary drive mechanism 120.

The ECU 60 calculates a current crank angle on the basis of an output pulse of the crank angle sensor 82 and a pulse of the cam angle sensor 92 and an engine speed NE on the basis of a frequency with which pulses are output from the crank angle sensor 82.

Although various signals are input to the input ports of the ECU 60 in addition to the aforementioned output voltages and pulses, they are not shown in the drawings because they are not important in explaining the first embodiment.

Each of the output ports of the ECU 60 is connected to a corresponding one of the fuel injectors 34 via a corresponding one of drive circuits. The ECU 60 performs an opening control of the fuel injectors 34 in accordance with an operational state of the engine 2 and thus performs a fuel injection timing control and a fuel injection amount control. Furthermore, one of the output ports of the ECU 60 is connected to an oil control valve (hereinafter referred to as the "OCV") 104 via a corresponding one of the drive circuits. The ECU 60 controls the slide actuator 100 through a hydraulic control by the OCV 104 in accordance with an operational state of the engine 2 such as a required intake air amount.

Figure 3:
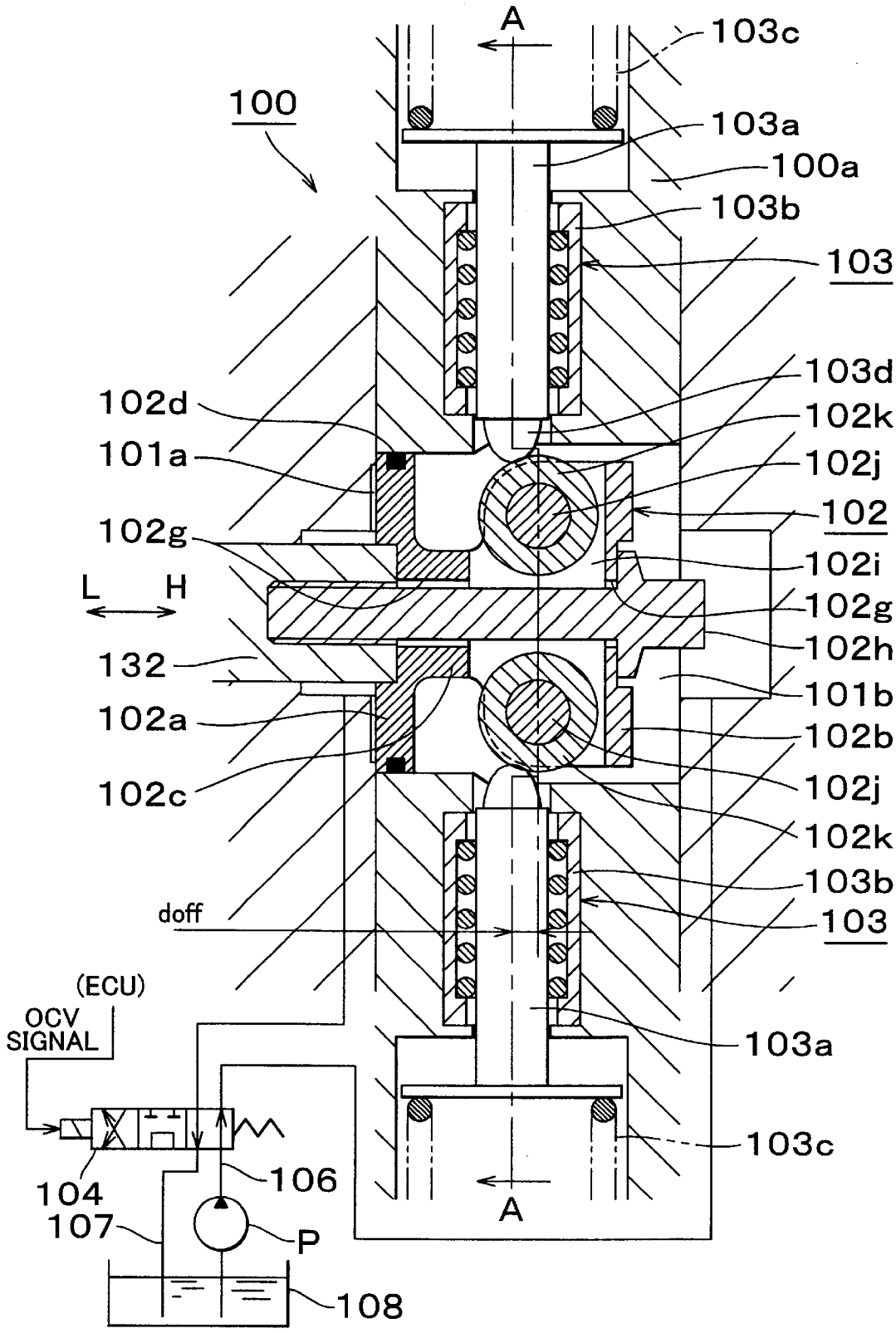
FIG. 3 is a cross-sectional view of the internal structure of a slide actuator according to the first embodiment.
Figure 4:
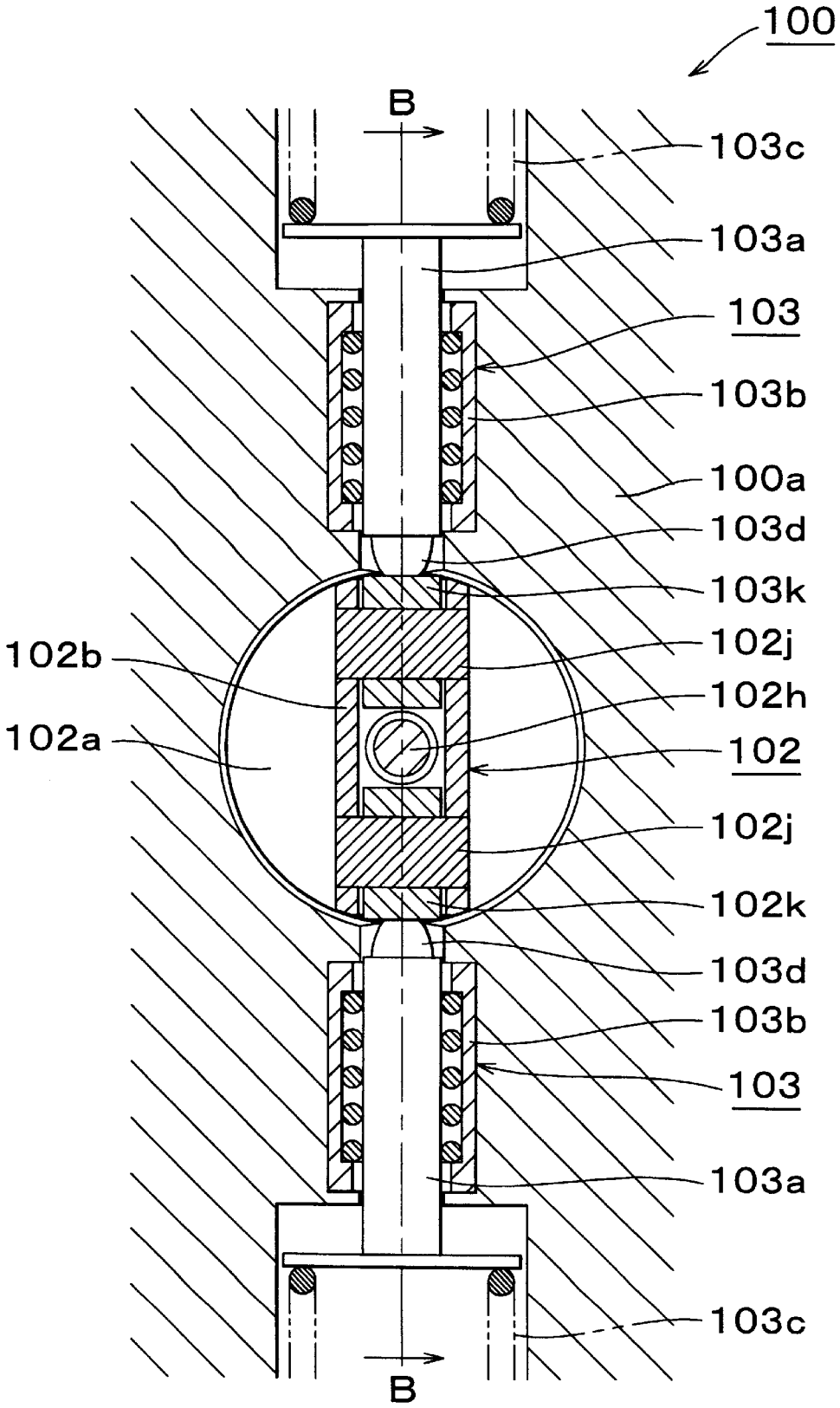
FIG. 4 is also a cross-sectional view according to the internal structure of the slide actuator.

Each of FIGS. 3 and 4 shows a cross-section of the internal structure of the slide actuator 100. FIG. 3 is a longitudinal cross-sectional view (taken along a line B—B in FIG. 4) when viewed from a location in front of the slide actuator 100. FIG. 4 is a longitudinal cross-sectional view (taken along a line A—A in FIG. 3) when viewed from a location on the right side of the slide actuator 100.

Figure 5:
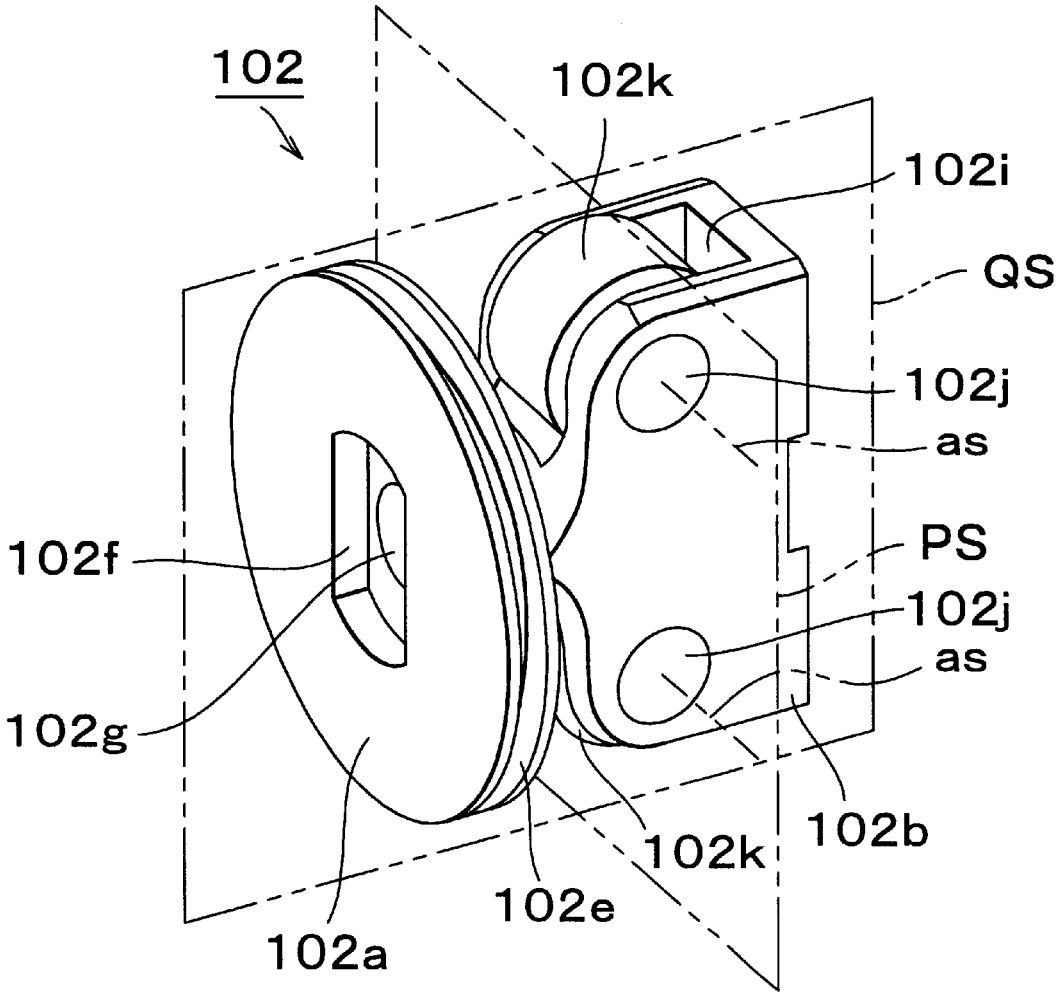
FIG. 5 is a perspective view of a piston body of the first embodiment.
Figure 6:
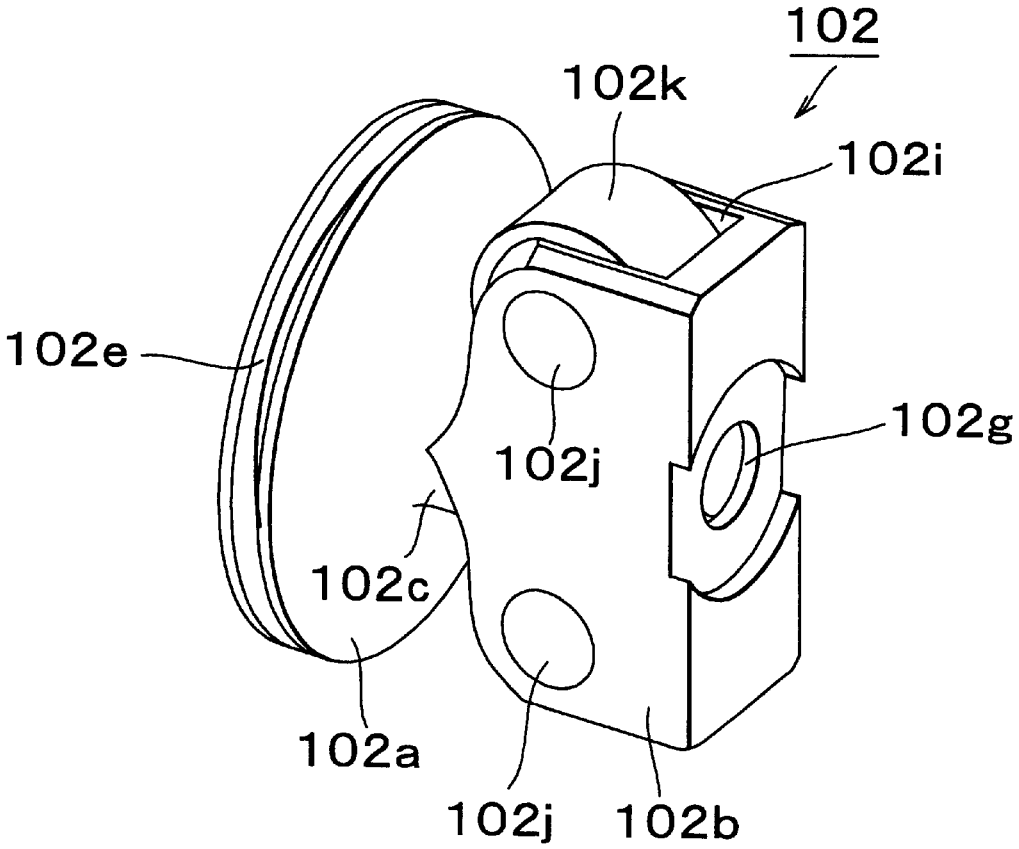
FIG. 6 is also a perspective view of the piston body.

The slide actuator 100 has a cylindrical space inside a housing 100*a*. The cylindrical space is formed so as to be coaxial with the control shaft 132. This space is slightly reduced in diameter on the side of the control shaft 132. A piston body 102 is axially movably disposed inside the space. As shown in perspective views of FIGS. 5 and 6, the piston body 102 includes a piston portion 102*a* and an assisting roller portion 102*b*. The piston portion 102*a* and the assisting roller portion 102*b* are integrally formed via a connecting portion 102*c*.

The piston portion 102*a* is in the shape of a circular plate. A sealing groove 102*e* for accommodating a sealing ring 102*d* for oil seal is formed in an outer peripheral surface of the piston portion 102*a*. A leading end of the control shaft 132 is fitted into a fitting hole 102*f* formed in the center of the piston portion 102*a*. The control shaft 132 is fixed to the piston body 102 by a fixture bolt 102*h* penetrating from the right side in FIG. 3, through a bolt through-hole 102*g* axially penetrating the piston body 102. As a result, the control shaft 132 is designed to be axially movable together with the piston body 102.

The piston portion 102*a* is disposed on the smaller-diameter side (on the left side in the drawings) in the cylindrical space. Hence, the cylindrical space is divided into two pressure chambers 101*a*, 101*b*. The ECU 60 adjusts the supply and release of a hydraulic pressure for the two pressure chambers 101*a*, 101*b* via the aforementioned OCV 104, whereby the entire piston body 102 axially moves and adjusts an axial position of the control shaft 132. The OCV 104 is a four-port three-position switching valve of an electromagnetic solenoid type. If the electromagnetic solenoid assumes a demagnetized state (hereinafter referred to as a "low-lift drive state") as shown in FIG. 3, hydraulic fluid in the first pressure chamber 101*a* is returned to an oil pan 108 via a discharge passage 107. A high-pressure hydraulic fluid is supplied from an oil pump P to the second pressure chamber 101*b* via a supply passage 106. Hence, the control shaft 132 is moved in a direction indicated by L in FIG. 3, whereby it becomes possible to reduce valve operation angles and valve lift amounts of the intake valves 12*a*, 12*b* through the function of the intermediary drive mechanism 120.

If the electromagnetic solenoid assumes an 100%-energized state (hereinafter referred to as a "high-lift drive state"), hydraulic fluid is supplied from the oil pump P to the first pressure chamber 101*a* via the supply passage 106. Hydraulic fluid in the second pressure chamber 101*b* is returned to the oil pan 108 via the discharge passage 107. Hence, the control shaft 132 is moved in a direction indicated by H in FIG. 3, whereby it becomes possible to increase valve lift amounts of the intake valves 12*a*, 12*b* through the function of the intermediary drive mechanism 120.

Furthermore, if the supply of electricity to the electromagnetic solenoid is controlled so as to assume an intermediate state (hereinafter referred to as a "neutral state"), the pressure chambers 101*a*, 101*b* are sealed and connected to neither the supply passage 106 nor the discharge passage 107. Hence, axial movements of the control shaft 132 are stopped, whereby it becomes possible to hold valve lift amounts of the intake valves 12*a*, 12*b*.

The assisting roller portion 102*b* will now be described. A space 102*i* penetrating in a direction perpendicular to the axial direction is formed in a body of the assisting roller portion 102*b*. Two shaft portions 102*j* penetrating the space 102*i* are symmetrically disposed across the fixture bolt 102*h*. Axes "as" (FIG. 5) of the two shaft portions 102*j* are disposed parallel to a virtual plane (PS) that is perpendicular to an axis of the control shaft 132. Each of rollers 102*k* is freely rotatably fitted to a corresponding one of the shaft portions 102*j*.

Each of two push portions 103 is disposed in the housing 100*a* in such a manner as to face a corresponding one of the two rollers 102*k*. Each of the push portions 103 has an output rod 103*a*, a linear bearing 103*b* for axially movably supporting the output rod 103*a*, and a spring 103*c* for urging the output rod 103*a* toward the piston body 102.

Figure 7A:
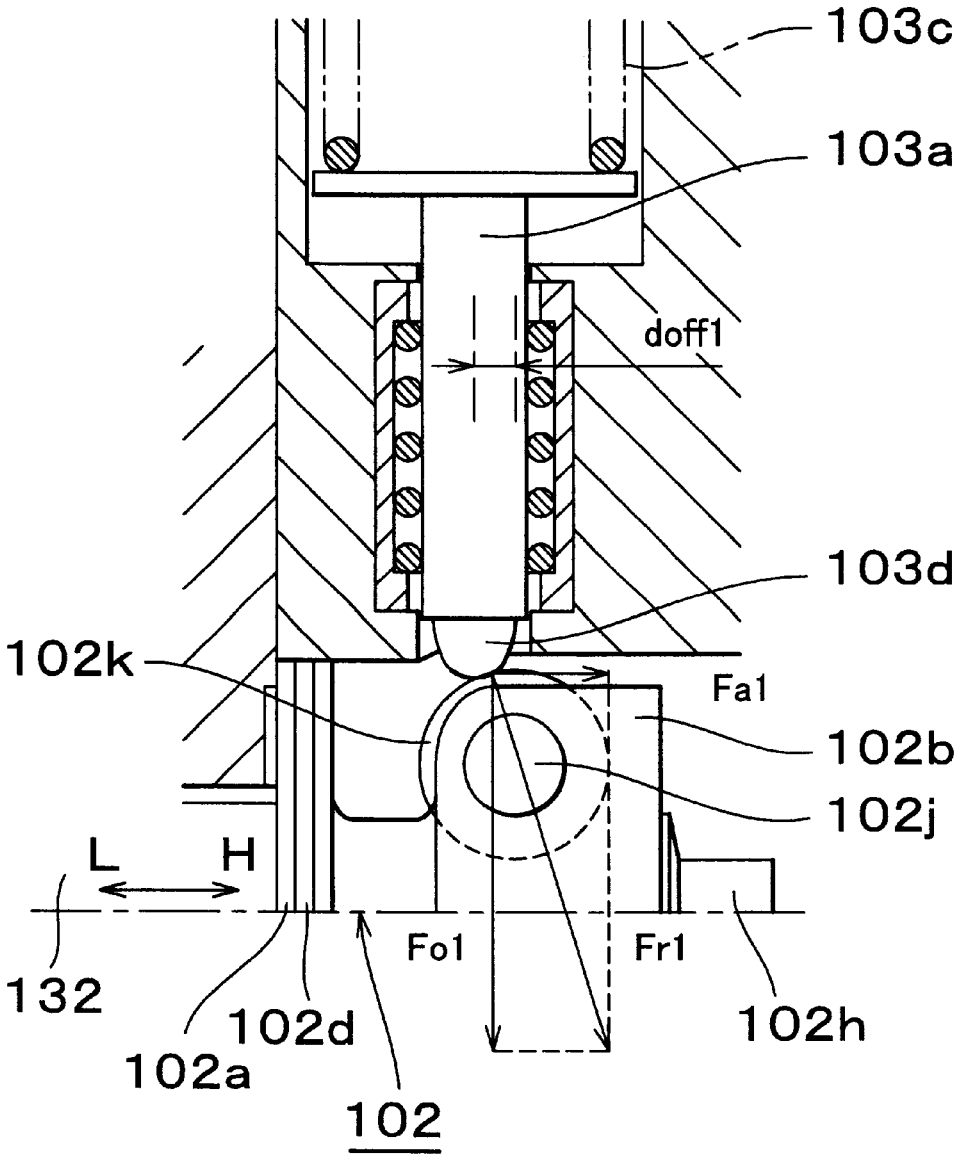
FIGS. 7A–7C are explanatory views of an assisting operation according to the first embodiment.

The direction in which the output rod 103*a* is urged is perpendicular to the axis of the control shaft 132. Furthermore, although the direction in which the output rod 103*a* is urged is parallel to a virtual plane (QS) perpendicular to the axes "as" of the rollers 102*k*, the output rod 103*a* has an offset doff toward the control shaft 132 from the axes "as" (FIG. 3). Accordingly, as shown in FIG. 7A, a pressure Fo1 is diagonally applied to an outer peripheral surface of the roller 102*k* from a leading end portion 103*d* of the output rod 103*a*. Hence, a radial force Fr1 is applied to the shaft portion 102*j*. As a result, an axial force Fa1 is applied to the piston body 102 from the output rod 103*a*. That is, the pressure Fo1 of the output rod 103*a* is converted into the axial force Fa1 with the cylindrical outer peripheral surface of the roller 102*k* serving as a conversion plane. The force Fa1 is applied in the direction H and acts as an assisting force that acts against a thrust force generated by the later-described intermediary drive mechanism 120 in the direction L. FIG. 7A shows a state where the piston body 102 is located at a critical position in the direction L and the offset doff is a minimum offset distance doff1.

Figure 7B:
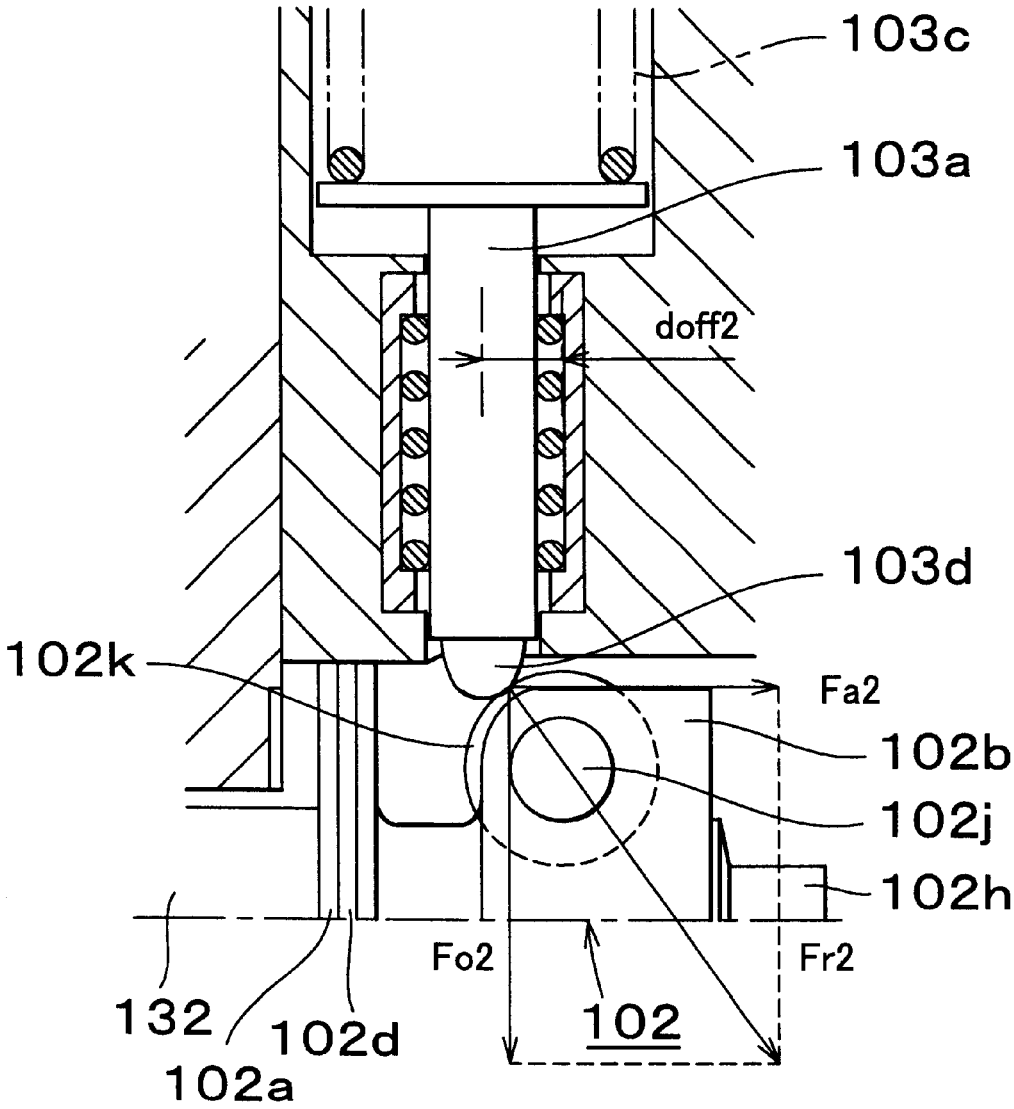

If the piston body 102 is moved in the direction H as shown in FIG. 7B through adjustment of hydraulic pressures in the pressure chambers 101*a*, 101*b* by the ECU 60 based on an OCV signal, the offset doff is an intermediate offset distance doff2. Hence, a pressure Fo2 is applied to the cylindrical outer peripheral surface of the roller 102*k* from the leading edge portion 103*d* of the output rod 103*a* in a further inclined direction. Hence, a radial force Fr2 is applied to the shaft portion 102*j*. As a result, an assisting force Fa2 (>Fa1) is applied to the piston body 102.

Figure 7C:
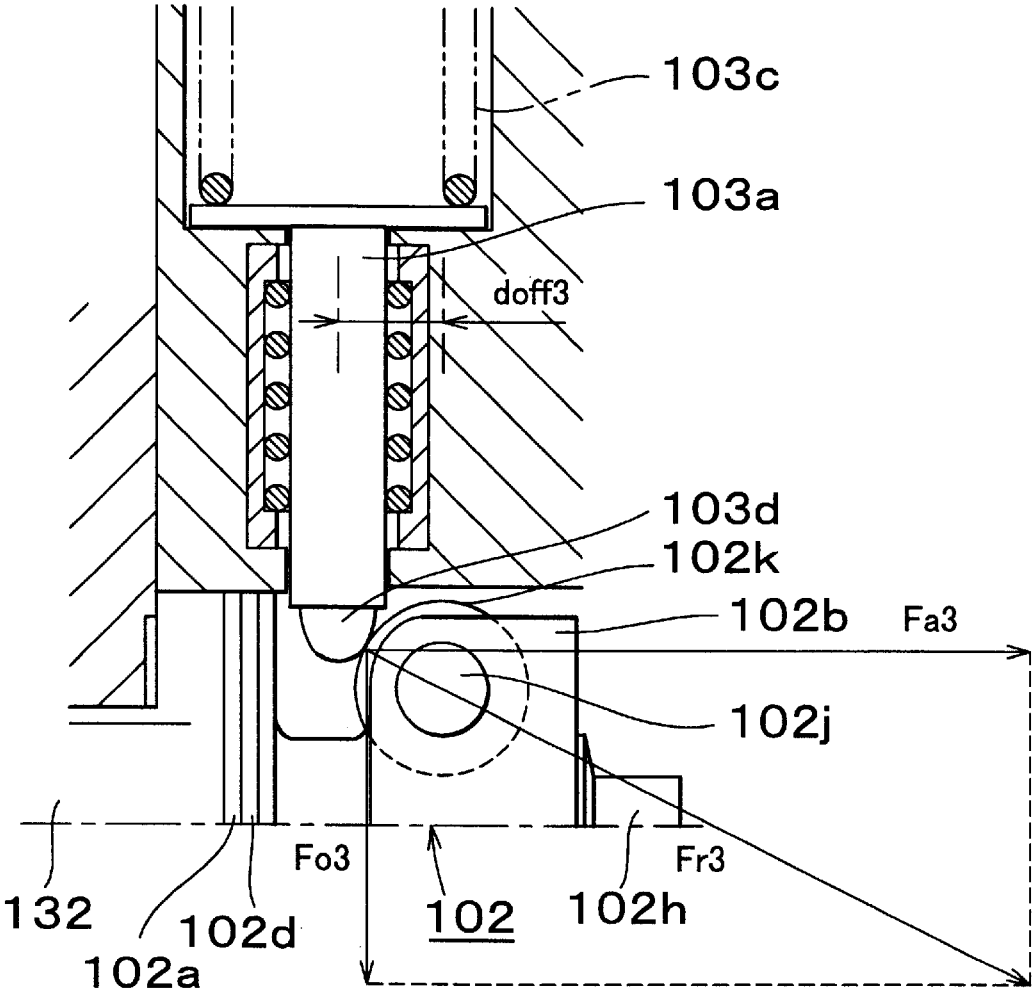

Furthermore, if the piston body 102 is moved to a critical position in the direction H as shown in FIG. 7C, the offset doff is a maximum offset distance doff3. Hence, a pressure Fo3 is applied to the cylindrical outer peripheral surface of the roller 102*k* from the leading portion 103*d* of the output rod 103*a* in a most inclined direction. Hence, a radial force Fr3 is applied to the shaft portion 102*j*. As a result, a maximum assisting force Fa3 (>Fa2) is applied to the piston body 102.

Figure 8:
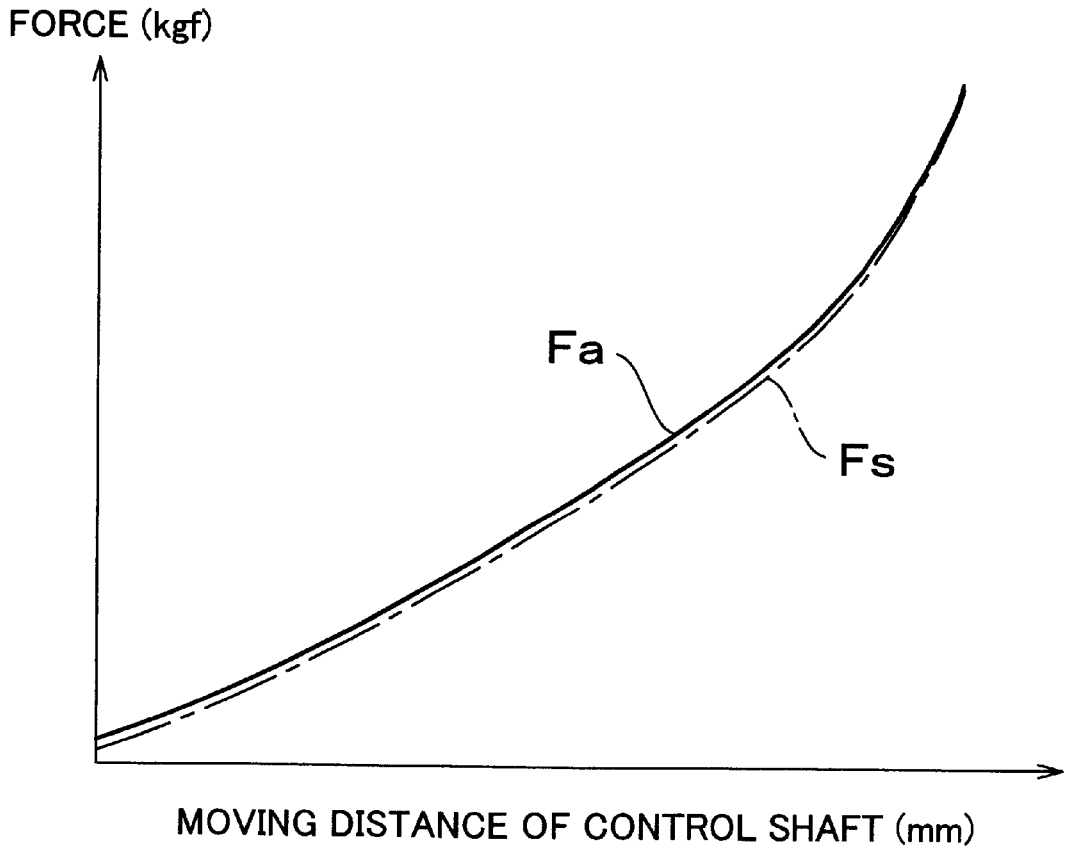
FIG. 8 is a graph showing how a thrust force Fs and an assisting force Fa are related to a moving distance of a control shaft.

A solid line in FIG. 8 indicates a relationship between an assisting force Fa and a moving distance of the control shaft 132 in the direction H which has been actually designed on the basis of the aforementioned relationship. That is, if the moving distance of the control shaft 132 in the direction H is "0(mm)" (at the critical position in the direction L), the assisting force Fa assumes a minimum value that is almost 0(kgf). The assisting force Fa increases as the control shaft 132 moves in the direction H. The assisting force Fa assumes a maximum value at the critical position in the direction H.

An alternate long and short dash line in FIG. 8 indicates a thrust force Fs (applied in the opposite direction) generated by the later-described intermediary drive mechanism 120. The assisting force Fa is set so as to become substantially equal to the absolute value of the thrust force Fs. Such an ascending pattern of the assisting force Fa can be suitably set by the shape of the leading end portion 103*d* of the output rod 103*a*, the diameter of the roller 102*k*, and the initial offset doff1. Although the ascending pattern of the thrust force Fs generated by the intermediary drive mechanism 120 slightly changes depending on the speed of the engine 2, it is appropriate that the ascending pattern of the assisting force Fa be adapted for, for example, a thrust force Fs at an average engine speed, a thrust force Fs at an engine speed during idling, or a thrust force Fs at a maximum engine speed.

Figure 9:
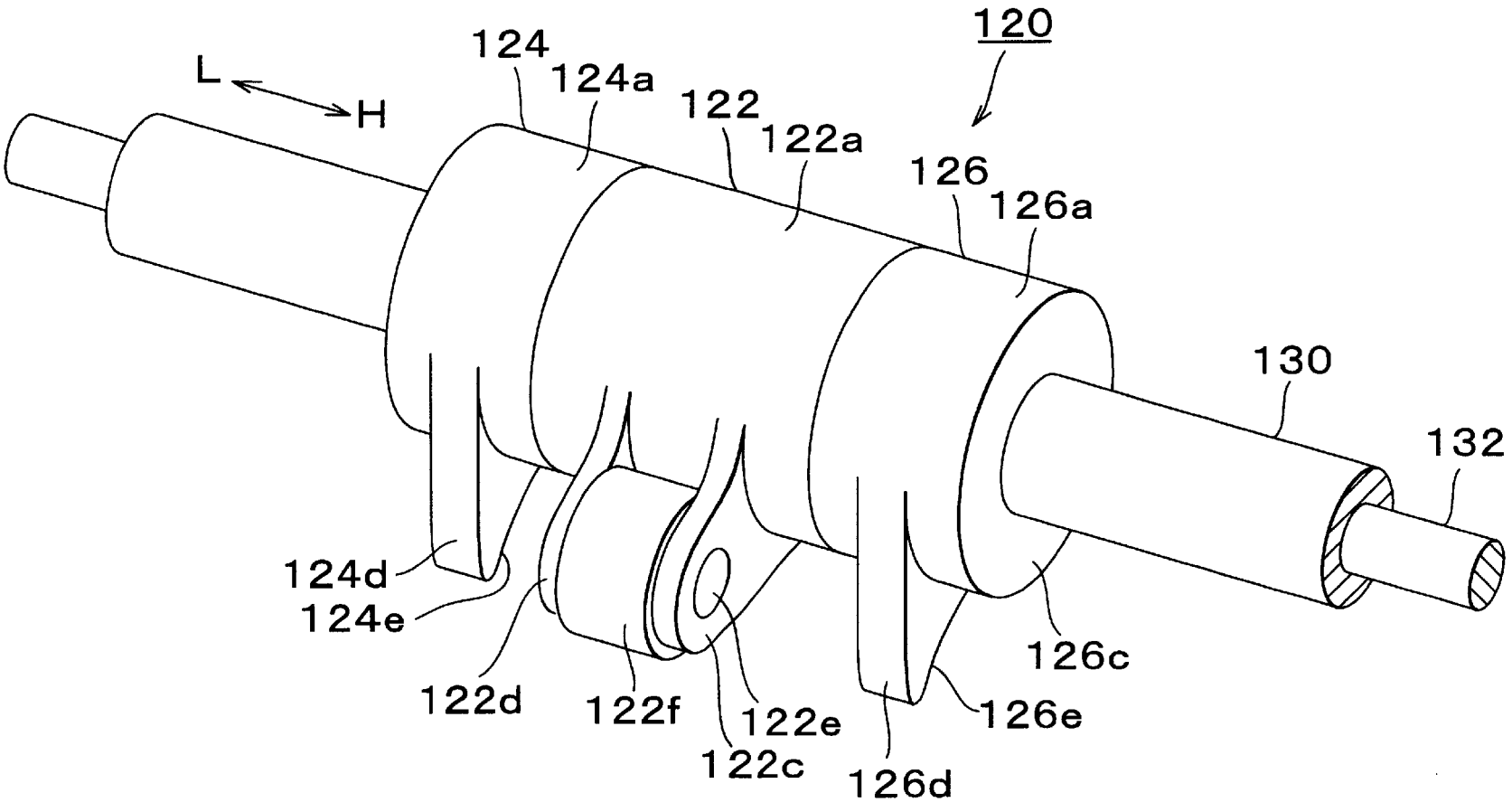
FIG. 9 is a perspective view of the structure of an intermediary drive mechanism according to the first embodiment.

The intermediary drive mechanism 120 will now be described. FIG. 9 is a perspective view of the intermediary drive mechanism 120. The intermediary drive mechanism 120 includes a shaft input portion 122 disposed at the center in the drawing, a first rocking cam 124 disposed on the left side in the drawing (corresponding to an "shaft output portion"), and a second rocking cam 126 disposed on the right side in the drawing (corresponding to an "shaft output portion"). A housing 122*a* of the shaft input portion 122 and housings 124*a*, 126*a* of the rocking cams 124, 126 have a cylindrical shape and are equal in outer diameter.

Figure 10:
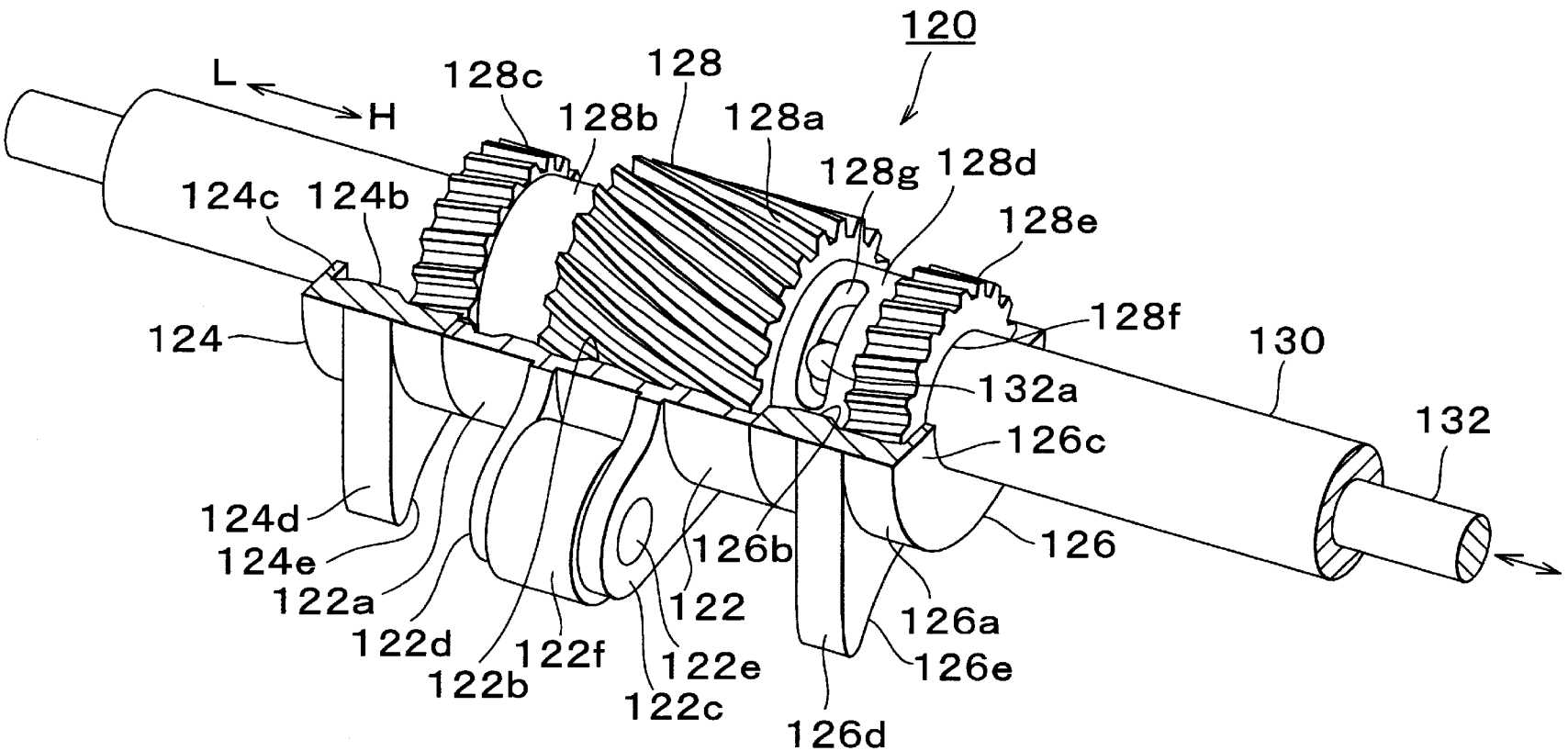
FIG. 10 is also a partially cutaway view of the internal structure of the intermediary drive mechanism.

FIG. 10 is a perspective view of the housings 122*a*, 124*a*, 126*a* that have been horizontally cut away. It is to be noted herein that an axially extending space is formed in the housing 122*a* of the shaft input portion 122 and that a helical spline 122*b* that axially spirals like a right-handed screw is formed in an inner peripheral surface of the space. Further, two arms 122*c*, 122*d* are formed so as to protrude from an outer peripheral surface in parallel with each other. A shaft 122*e* is hung between leading ends of the arms 122*c*, 122*d*. The shaft 122*e* is parallel to an axis of the housing 122*a*. A roller 122*f* is rotatably fitted to the shaft 122*e*.

An axially extending space is formed in the housing 124*a* of the first rocking cam 124, and a helical spline 124*b* that axially spirals like a left-handed screw is formed in an inner peripheral surface of the internal space. A ring-like bearing portion 124*c* having a center hole with a reduced diameter covers a left end of the internal space. A generally triangular nose 124*d* is formed so as to protrude from an outer peripheral surface. One side of the nose 124*d* constitutes a cam surface 124*e* that is concavely curved.

An axially extending space is formed in the housing 126*a* of the second rocking cam 126, and a helical spline 126*b* that axially spirals like a left-handed screw is formed in an inner peripheral surface of the internal space. A ring-like bearing portion 126*c* having a center hole with a reduced diameter covers a right end of the internal space. A generally triangular nose 126*d* is formed so as to protrude from an outer peripheral surface. An upper side of the nose 126*d* constitutes a cam surface 126*e* that is concavely curved.

The first rocking cam 124 and the second rocking cam 126 are disposed such that their end surfaces are respectively in contact with opposed ends of the shaft input portion 122 in a coaxial manner with the bearing portions 124*c*, 126*c* facing outwards. As a whole, the first rocking cam 124, the shaft input portion 122, and the second rocking cam 126 assume a generally cylindrical shape having an internal space as shown in FIG. 9.

A slider gear 128 is disposed in the internal space that is constituted by the shaft input portion 122 and the two rocking cams 124, 126. The slider gear 128 has a generally cylindrical shape, and an input helical spline 128*a* that spirals like a right-handed screw is formed at the center of an outer peripheral surface of the slider gear 128. A first output helical spline 128*c* that spirals like a left-handed screw is formed at a left end portion of the input helical spline 128*a*, with a small-diameter portion 128*b* being interposed between the input helical spline 128*a* and the first output helical spline 128*c*. A second output helical spline 128*e* that spirals like a left-handed screw is formed at a right end portion of the input helical spline 128*a*, with a small-diameter portion 128*d* being interposed between the input helical spline 128*a* and the second output helical spline 128*e*. It is to be noted herein that the output helical splines 128*c*, 128*e* are smaller in outer diameter than the input helical spline 128*a*.

A through-hole 128*f* is formed in the slider gear 128 in the direction of a center axis thereof. A long hole 128*g* for opening the inside of the through-hole 128*f* to the outer peripheral surface is formed in one of the small-diameter portions 128*d*. The long hole 128*g* has a circumferentially extended length.

Figure 11A:
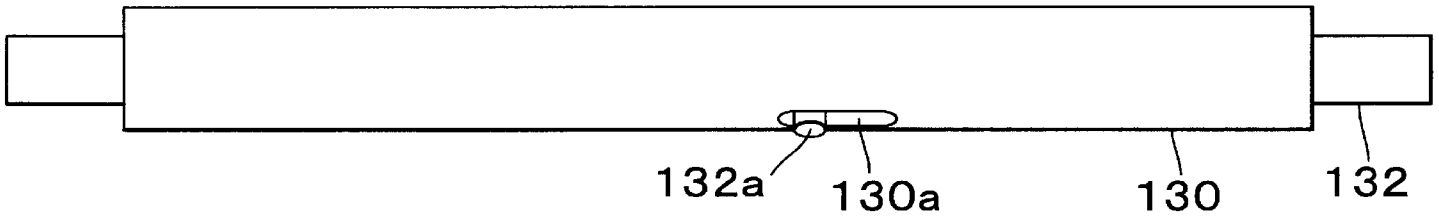
FIGS. 11A–11C are explanatory views of the shapes of a control shaft and a supporting pipe of the intermediary drive mechanism.
Figure 11B:
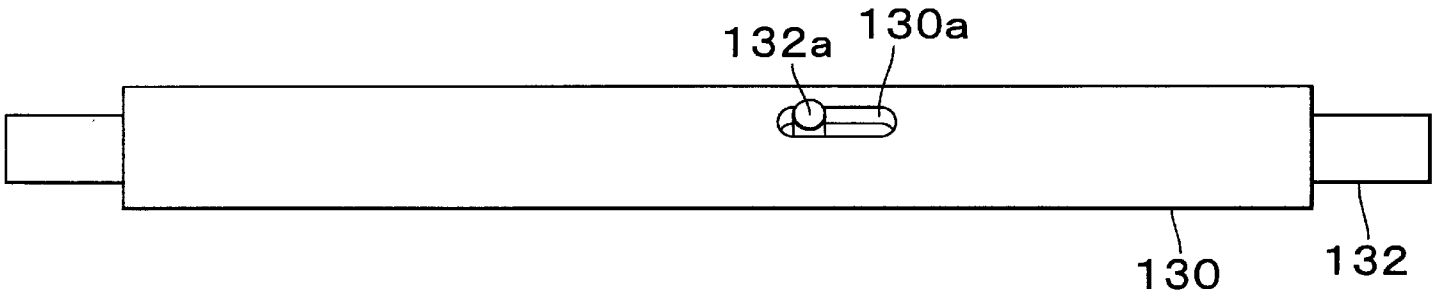
Figure 11C:
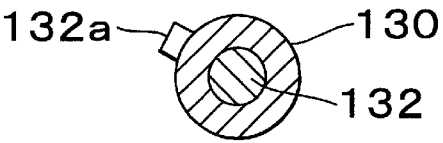

A supporting pipe 130 as shown in FIG. 11 is circumferentially slidably disposed in the through-hole 128*f* of the slider gear 128. It is to be noted herein that FIG. 11A is a plan view, that FIG. 11B is a front view, and that FIG. 11C is a right side view. As shown in FIG. 2, the supporting pipe 130 is commonly provided for all the intermediary drive mechanisms 120 (the number of the intermediary drive mechanisms 120 is four in this case). For each of the intermediary drive mechanisms 120, a corresponding one of axially extended long holes 130*a* is opened in the supporting pipe 130.

Furthermore, a control shaft 132 axially slidably penetrates the supporting pipe 130. As is the case with the supporting pipe 130, the control shaft 132 is also commonly provided for all the intermediary drive mechanisms 120. For each of the intermediary drive mechanisms 120, a corresponding one of engaging pins 132*a* protrudes from the control shaft 132. Each of the engaging pins 132*a* is formed so as to penetrate a corresponding one of the axially extended long holes 130*a* formed in the supporting pipe 130. Furthermore, the leading end of each of the engaging pins 132*a* of the control shaft 132 is inserted through the circumferentially extended long hole 128*g* formed in the slider gear 128 of a corresponding one of the intermediary drive mechanisms 120.

Because of the axially extended long holes 130*a* formed in the supporting pipe 130, even if the supporting pipe 130 is fixed to the cylinder head 8, each of the engaging pins 132*a* of the control shaft 132 can be axially moved and thus makes it possible to axially move the slider gear 128. In addition, the slider gear 128 itself is engaged in the circumferentially extended long hole 128*g* with a corresponding one of the engaging pins 132*a* and is thereby axially positioned. On the other hand, however, the slider gear 128 can rock around the axis.

The input helical spline 128*a* of the slider gear 128 is engaged with the helical spline 122*b* inside the shaft input portion 122. Further, the first output helical spline 128*c* is engaged with the helical spline 124*b* inside the first rocking cam 124. The second output helical spline 128*e* is engaged with the helical spline 126*b* inside the second rocking cam 126.

As shown in FIG. 2, each of the intermediary drive mechanisms 120 thus constructed can rock around the axis but is prevented from being axially moved while being interposed between rising wall portions 136, 138 formed in the cylinder head 8 on the side of the bearing portions 124*c*, 126*c* of the rocking cams 124, 126. Holes are formed in the rising wall portions 136, 138 at positions corresponding to the center holes of the bearing portions 124*c*, 126*c*, respectively. The supporting pipe 130 is passed through the holes and fixed thereby. Accordingly, the supporting pipe 130 is fixed to the cylinder head 8 and does not axially move or rotate.

The control shaft 132 in the supporting pipe 130 axially slidably penetrates the supporting pipe 130 and is connected at one end thereof to the piston body 102 of the slide actuator 100 shown in FIGS. 3 and 7. Thus, the axial position of the control shaft 132 can be adjusted by adjusting hydraulic pressures applied to the pressure chambers 101*a*, 101*b*. Hence, the difference in phase between the roller 122*f* of the shaft input portion 122 and the noses 124*d*, 126*d* of the rocking cams 124, 126 can be adjusted by way of the control shaft 132 and the slider gear 128. That is, as shown in FIGS. 12 to 14, valve lift amounts of the intake valves 12*a*, 12*b* can be made continuously variable by driving the slide actuator 100.

Figure 12B:
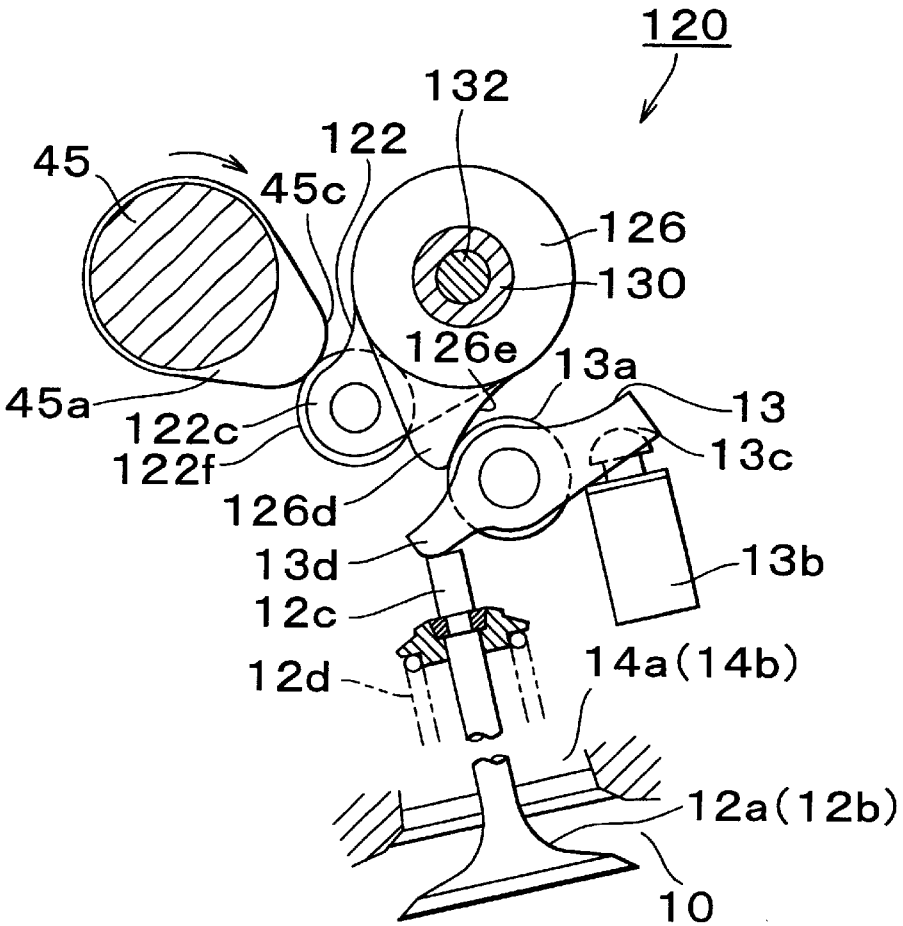
FIGS. 12A–12B are explanatory views of a valve lift amount adjusting function of the intermediary drive mechanism according to the first embodiment.
Figure 12A:
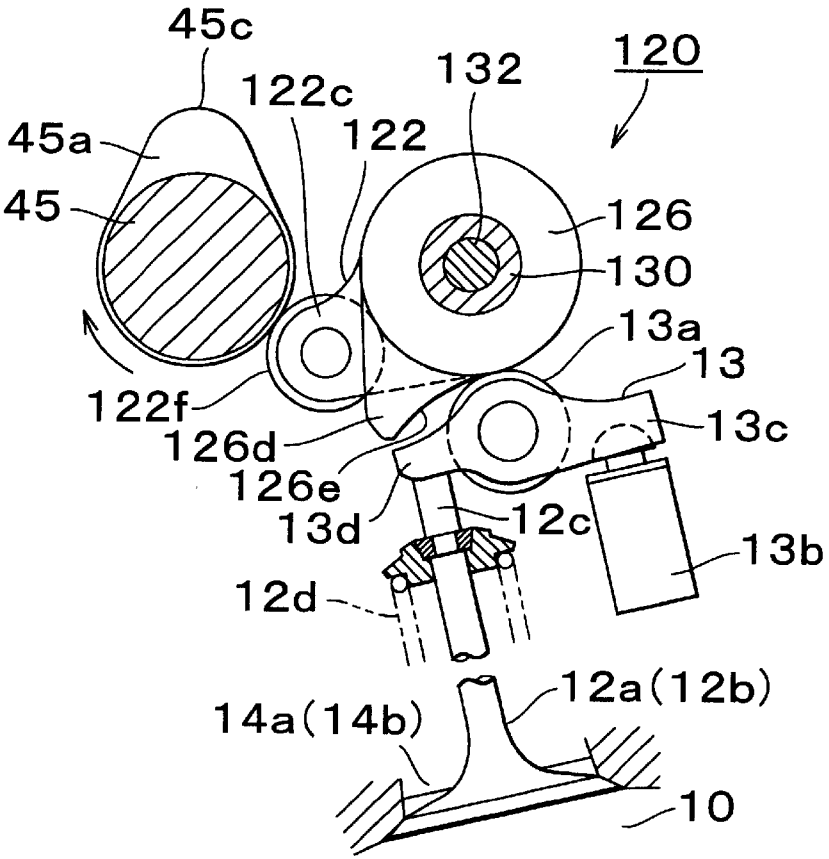

It is to be noted herein that FIGS. 12A and 12B shows the intermediary drive mechanism 120 in a state where the control shaft 132 has been moved to the critical position in the direction H by the slide actuator 100. That is, FIGS. 12A and 12B correspond to the state shown in FIG. 7C. While FIGS. 12 to 15 show a mechanism in which the second rocking cam 126 drives the first intake valve 12*a*, the same holds true for a mechanism in which the first rocking cam 124 drives the second intake valve 12*b*. Therefore, the following description will be accompanied by reference symbols of the first rocking cam 124 and the second intake valve 12*b* as well.

In FIG. 12A, a base circle portion (a portion other than the nose 45*c*) of the intake cam 45*a* is in contact with the roller 122*f* of the shaft input portion 122 in the intermediary drive mechanism 120. Although not shown, the roller 122 is urged by a spring so as to be always in contact with the side of the intake cam 45*a*. In this state, the noses 124*d*, 126*d* of the rocking cams 124, 126 are not in contact with a roller 13*a* of a rocker arm 13. The base circle portion adjacent to the noses 124*d*, 126*d* is in contact with the roller 13*a* of the rocker arm 13. Hence, the intake valves 12*a*, 12*b* are closed.

If the nose 45*c* of the intake cam 45*a* depresses the roller 122*f* of the shaft input portion 122 through rotation of the intake cam shaft 45, rocking movements are transmitted from the shaft input portion 122 to the rocking cams 124, 126 via the slider gear 128 in the intermediary drive mechanism 120, and the rocking cams 124, 126 rock in such a manner as to depress the noses 124*d*, 126*d* respectively. Hence, curved cam surfaces 124*e*, 126*e* formed on the noses 124*d*, 126*d* immediately come into contact with the roller 13*a* of the rocker arm 13. As shown in FIG. 12B, the rocking cams 124, 126 depress the roller 13*a* of the rocker arm 13 by means of the entire cam surfaces 124*e*, 126*e*, whereby the rocker arm 13 rocks around the side of a base end portion 13*c* supported by an adjuster 13*b* and a leading edge portion 13*d* of the rocker arm 13 greatly depresses a stem end 12*c*. Thus, the intake valves 12*a*, 12*b* open the intake ports 14*a*, 14*b* respectively with a maximum valve lift amount.

Figure 13B:
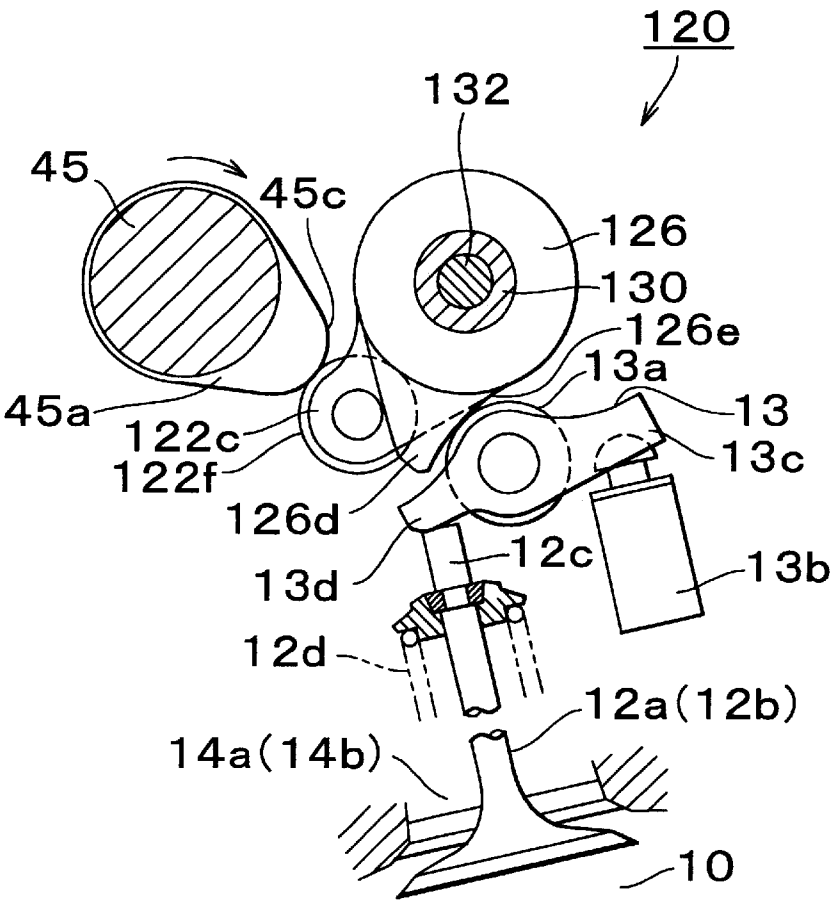
FIGS. 13A–13B are explanatory views of a valve lift amount adjusting function of the intermediary drive mechanism.
Figure 13A:
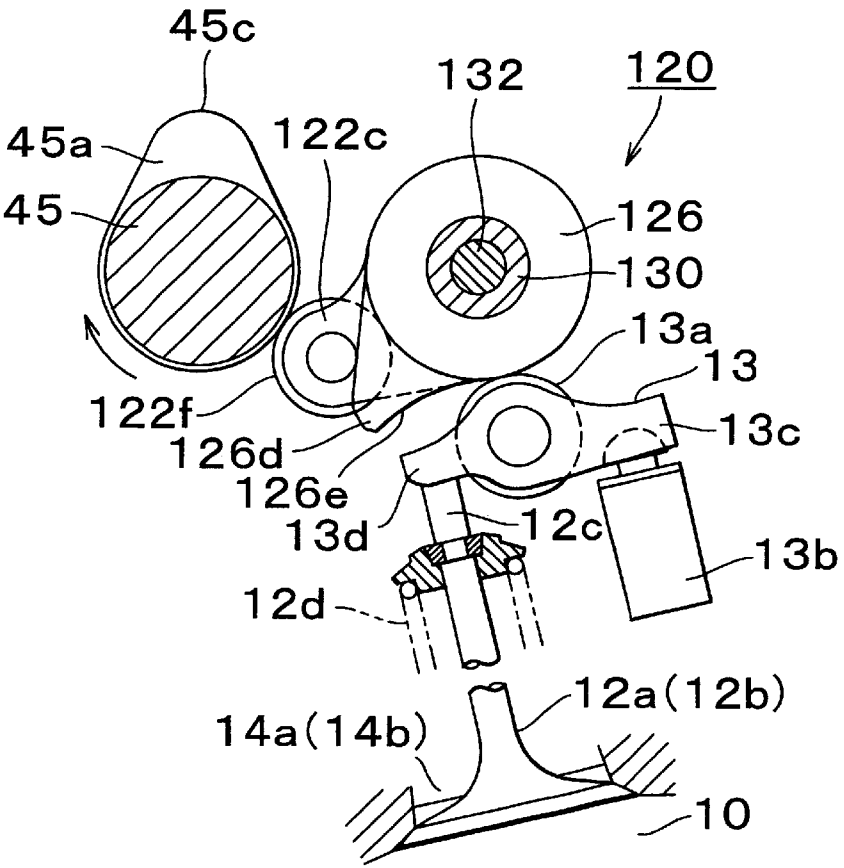

FIGS. 13A and 13B show a state of the intermediary drive mechanism 120 in the case where the control shaft 132 has been returned by the slide actuator 100 from the state shown in FIGS. 12A and 12B in the direction L. That is, FIGS. 13A and 13B correspond to the state shown in FIG. 7B.

In FIG. 13A, the base circle portion of the intake cam 45*a* is in contact with the roller 122*f* of the shaft input portion 122 in the intermediary drive mechanism 120. In this state, the noses 124*d*, 126*d* of the rocking cams 124, 126 are not in contact with the roller 13*a* of the rocker arm 13. A base circle portion that is spaced slightly further apart from the noses 124*d*, 126*d* in comparison with the case of FIGS. 12A and 12B is in contact with the roller 13*a* of the rocker arm 13. Hence, the intake valves 12*a*, 12*b* are closed. This is because the slider gear 128 has moved in the direction L in the intermediary drive mechanism 120 and thus the difference in phase between the roller 122*f* of the shaft input portion 122 and the noses 124*d*, 126*d* of the rocking cams 124, 126 has become small.

If the nose 45*c* of the intake cam 45*a* depresses the roller 122*f* of the shaft input portion 122 through rotation of the intake cam shaft 45, rocking movements are transmitted from the shaft input portion 122 to the rocking cams 124, 126 via the slider gear 128 in the intermediary drive mechanism 120, and the rocking cams 124, 126 rock in such a manner as to depress the noses 124*d*, 126*d* respectively.

As described above, in the state shown in FIG. 13A, the base circle portion that is spaced apart from the noses 124*d*, 126*d* is in contact with the roller 13*a* of the rocker arm 13. Hence, even if the rocking cams 124, 126 have rocked, the roller 13*a* of the rocker arm 13 remains in contact with the base circle portion for a while without coming into contact with the curved cam surfaces 124*e*, 126*e* formed on the noses 124*d*, 126*d*. Thereafter, the curved cam surfaces 124*e*, 126*e* come into contact with the roller 13*a* and depress the roller 13*a* of the rocker arm 13 as shown in FIG. 13B. Hence, the rocker arm 13 rocks around the base end portion 13*c*. However, since the roller 13*a* of the rocker arm 13 is spaced apart from the noses 124*d*, 126*d* at the beginning, the cam surfaces 124*e*, 126*e* have a correspondingly reduced area available. Thus, the rocking angle of the rocker arm 13 is reduced, and the amount by which the leading end portion 13*d* of the rocker arm 13 depresses the stem end 12*c*, namely, the valve lift amount is reduced. Hence, the intake valves 12*a*, 12*b* open the intake ports 14*a*, 14*b* respectively with a valve lift amount smaller than the maximum valve lift amount.

Figure 14B:
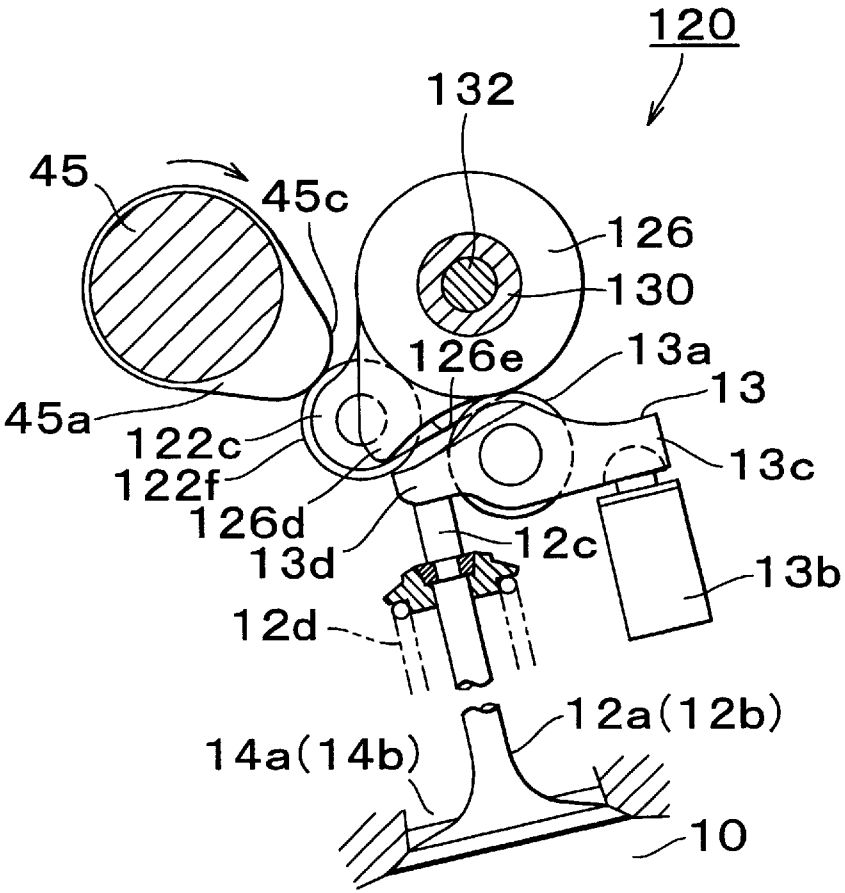
FIGS. 14A–14B are explanatory views of a valve lift amount adjusting function of the intermediary drive mechanism.
Figure 14A:
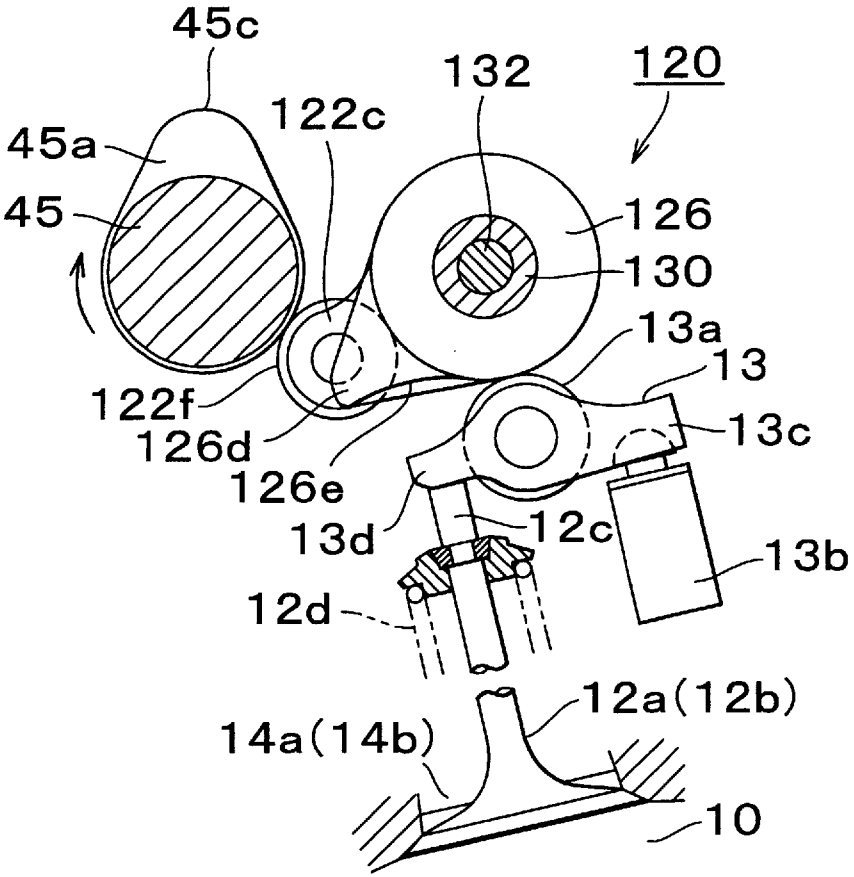

FIGS. 14A and 14B show a state of the intermediary drive mechanism 120 in the case where the control shaft 132 has been returned by the slide actuator 100 to the maximum extent in the direction L. That is, FIGS. 14A and 14B correspond to the state shown in FIG. 7A. In the state shown in FIG. 14A, the base circle portion that is spaced far apart from the noses 124*d*, 126*d* is in contact with the roller 13*a* of the rocker arm 13. Hence, for an entire period of rocking movements, the roller 13*a* of the rocker arm 13 remains in contact with the base circle portion without coming into contact with the curved surfaces 124*e*, 126*e* formed on the noses 124*d*, 126*d*. That is, as shown in FIG. 14B, even if the nose 45*c* of the intake cam 45*a* has depressed the roller 122*f* of the shaft input portion 122 to the maximum extent, the curved cam surfaces 124*e*, 126*e* are not used to depress the roller 13*a* of the rocker arm 13. Hence, the rocker arm 13 does not rock around the base end portion 13*c*, and the amount by which the leading end portion 13*d* of the rocker arm 13 depresses the stem end 12*c*, namely, the valve lift amount is "0". Thus, even if the intake cam shaft 45 rotates, the intake valves 12*a*, 12*b* hold the intake ports 14*a*, 14*b* closed respectively.

Figure 15:
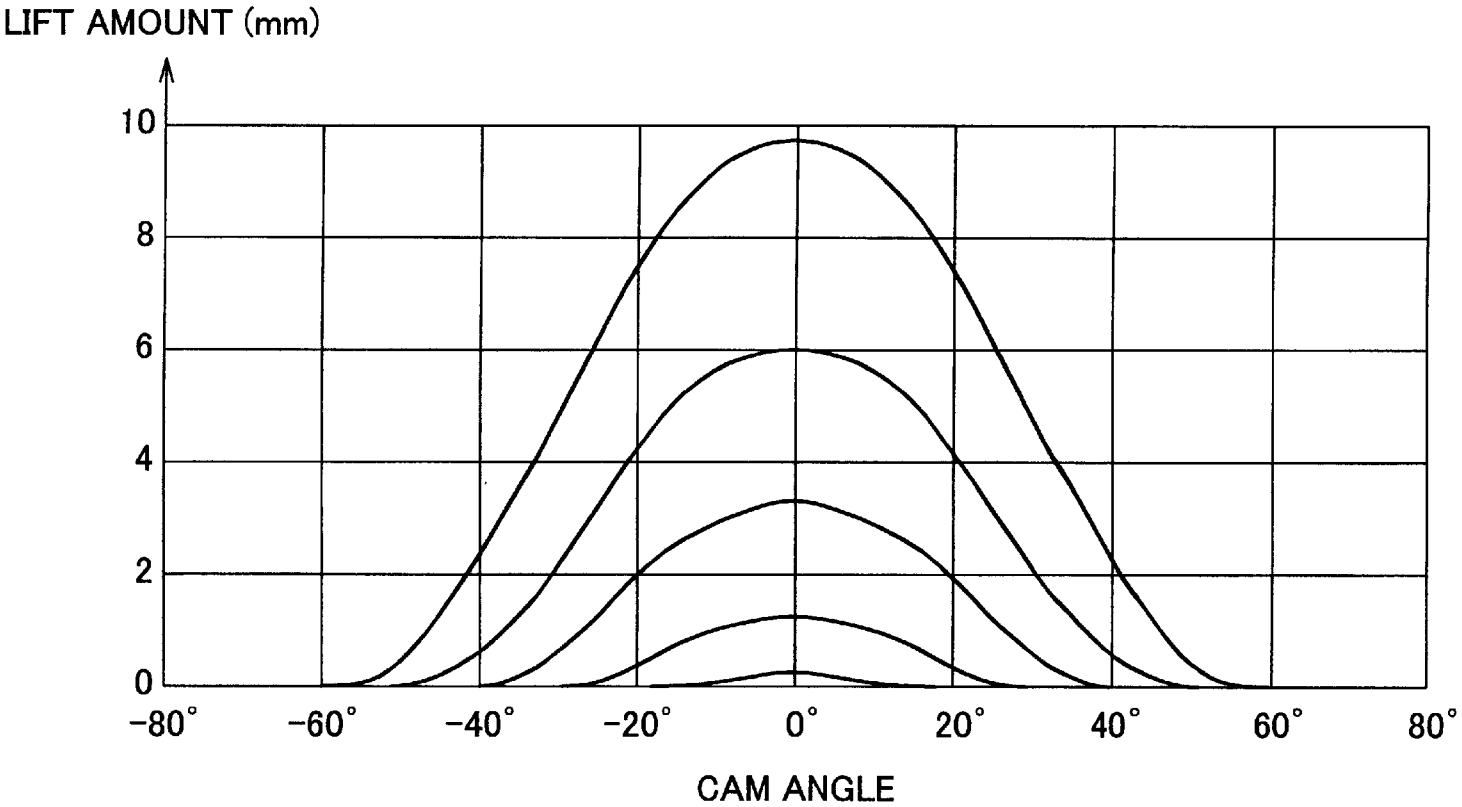
FIG. 15 is a graph showing how the valve lift amount achieved by the intermediary drive mechanism according to the first embodiment changes.

By thus adjusting the axial position of the control shaft 132 by means of the slide actuator 100, it becomes possible to continuously adjust valve lift amounts of the intake valves 12*a*, 12*b* as indicated by solid lines in a graph shown in FIG. 15.

In the case where the intake valves 12*a*, 12*b* are opened, forces are applied from valve springs 12*d* of the intake valves 12*a*, 12*d* via the rocker arm in such a direction as to narrow an angle between the arm 122*c* and the noses 124*d*, 126*d*. Thus, a thrust force is generated in the slider gear 128 so as to cause a movement in the direction L. Hence, a thrust force Fs for moving the control shaft 132 in the direction L is applied via the engaging pins 132*a*. The more the valve lift amounts of the intake valves 12*a*, 12*b* are increased, the more firmly the valve springs 12*d* are compressed. Hence, the thrust force Fs generated in the control shaft 132 is increased as the slide actuator 100 moves the control shaft 132 in the direction H, as indicated by an alternate long and short dash line in FIG. 8.

In the aforementioned structure of the first embodiment, a combination of the piston body 102 and the push portion 103 corresponds to an assisting force applying portion, the push portion 103 corresponds to an assisting force output portion, and the outer peripheral surface of the roller 102*k* corresponds to a conversion plane.

The following effects are obtained from the first embodiment that has been described above.

(a) A force output by the output rod 103*a* is converted into an assisting force via the roller 102*k* while the outer peripheral surface of the roller 102*k* moving together with the control shaft 132 serves as a conversion plane. The force thus converted is applied to the control shaft 132. Hence, as shown in FIG. 8, as the control shaft 132 moves in such a direction as to increase valve lift amounts of the intake valves 12*a*, 12*b*, the assisting force can be correspondingly increased. Accordingly, a suitable assisting force that can act against a thrust force generated in the intermediary drive mechanism 120 can be applied to the control shaft 132.

As a result, even if the pressure-receiving area of the piston portion 102*a* has been reduced for the sake of responding properties, there is no apprehension that a minimum hydraulic fluid pressure will not be ensured on the side with a large valve lift amount or that a delay will be caused in responding properties during movements of the control shaft 132.

(b) A restoring force of the spring 103*c* is used in an output from the output rod 103*a*. Thus, the more easily the axial position of the control shaft 132 is shifted to the high-lift side with a relatively simple structure, the more the assisting force can be increased. Moreover, unlike the case of a magnetic force or the like, the restoring force is not weakened suddenly. That is, an assisting force that is sufficient even for axial movements of the control shaft 132 over an extensive range is generated.

(c) In particular, the slide actuator 100 is applied to the intake valves 12*a*, 12*b* and used to adjust their valve lift amounts. Even for such a use, a suitable assisting force can be applied to the control shaft 132 due to the aforementioned structure. Therefore, the intake air amount of the engine 2 can be regulated with a quick response.

Figure 16:
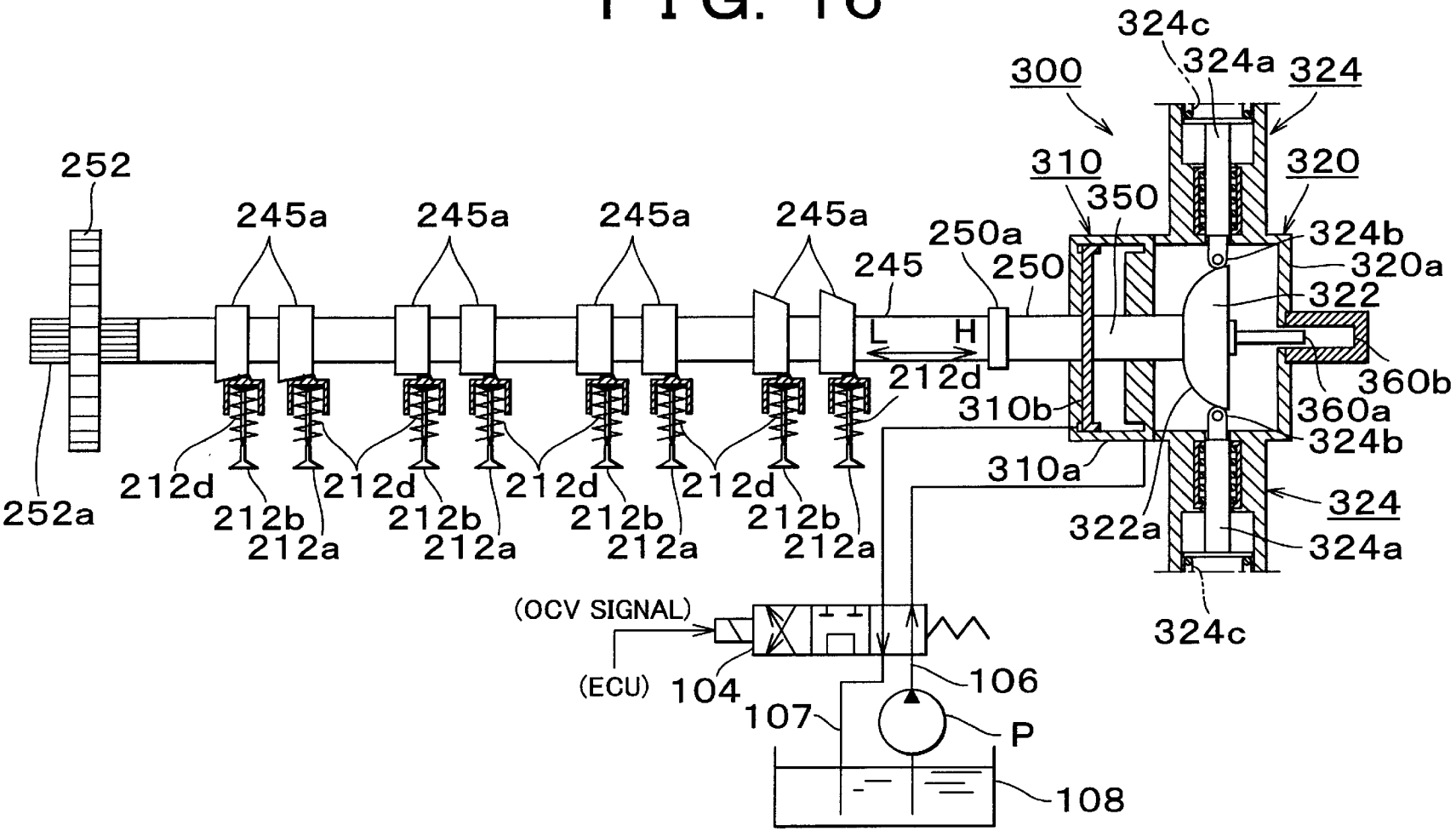
FIG. 16 is an explanatory view of the structure of a variable valve mechanism and an assisting device according to a second embodiment of the invention.

In a second embodiment, valve lift amounts of intake valves 212*a*, 212*b* are adjusted by a slide actuator 300 through axial movements of an auxiliary shaft 250 that is connected to an intake cam shaft 245 via a roller bearing portion 250*a* as shown in FIG. 16. The intake cam shaft 245 is interlocked with rotation of the crank shaft of the engine via a timing sprocket (which may be replaced with a timing gear or a timing pulley) disposed at one end of the intake cam shaft 245. However, since the auxiliary shaft 250 is connected to the intake cam shaft 245 via the roller bearing portion 250*a*, it does not rotate in such a manner as to interlock with rotation of the intake cam shaft 245. The auxiliary shaft 250 moves together with the intake cam shaft 245 only in the axial direction. It is to be noted herein that a timing sprocket 252 connected to the intake cam shaft 245 is supported so as to be rotatable with respect to the cylinder block of the engine but immovable in the axial direction. However, the timing sprocket 252 is connected at a central portion thereof to the intake cam shaft 245 via a straight spline mechanism 252*a*, thus allowing axial movements of the intake cam shaft 245.

It is to be noted herein that intake cams 245*a* on the intake cam shaft 245 are designed as three-dimensional cams that continuously change in profile in the axial direction. More specifically, the intake cams 245*a* are formed such that their cam noses are reduced in height toward the right side in FIG. 16 and increased in height toward the left side in FIG. 16. Such changes in profile make it possible to change valve lift amounts substantially in the same manner as shown in FIG. 15.

The slide actuator 300 includes a piston portion 310 and an assisting portion 320. The piston portion 310 is designed such that a piston 310*b* is accommodated in a cylinder 310*a*. The piston 310*b* is connected to the auxiliary shaft 250. In accordance with a state of supply of a hydraulic pressure from the OCV 104 that is controlled by the ECU, the piston 310*b* moves as indicated by an arrow, whereby the intake cam shaft 245 can be axially moved via the auxiliary shaft 250 and the bearing portion 250*a*.

The assisting portion 320 includes a slide cam 322 in a housing 320*a*. In this case, the slide cam 322 has a generally hemispherical shape and is connected in a rotational center axis portion on the spherical side to a coupling shaft 350. The coupling shaft 350 is coaxially connected to the piston 310*b* on the other side of the auxiliary shaft 250. Accordingly, the axial position of the slide cam 322 is interlocked with a position of displacement of the piston 310*b*.

A roller 324*b* disposed at a leading end of an output rod 324*a* provided in a push portion 324 is in contact with a generally spherical cam surface 322*a* of the slide cam 322. It is to be noted herein that the push portion 324 is different only in a roller portion 324*b* and basically identical in structure with the push portion 103 of the aforementioned first embodiment. That is, the output rod 324*a* presses the cam surface 322*a* of the slide cam 322 by means of a compressed spring 324*c*, and applies an assisting force acting in the direction H to the intake cam shaft 245 via the piston 310*b*, the auxiliary shaft 250, and the bearing portion 250*a*. A stroke sensor core 360*a* is mounted in a central portion of the slide cam 322 on the other side of the coupling shaft 350. A leading edge of the stroke sensor core 360*a* is inserted into a stroke sensor coil 360*b* that is attached to the housing 320*a*. Hence, a shaft position of the intake cam shaft 245 is detected, and a signal corresponding to the shaft position is output to the ECU from the stroke sensor coil 360*b*.

Figure 17:
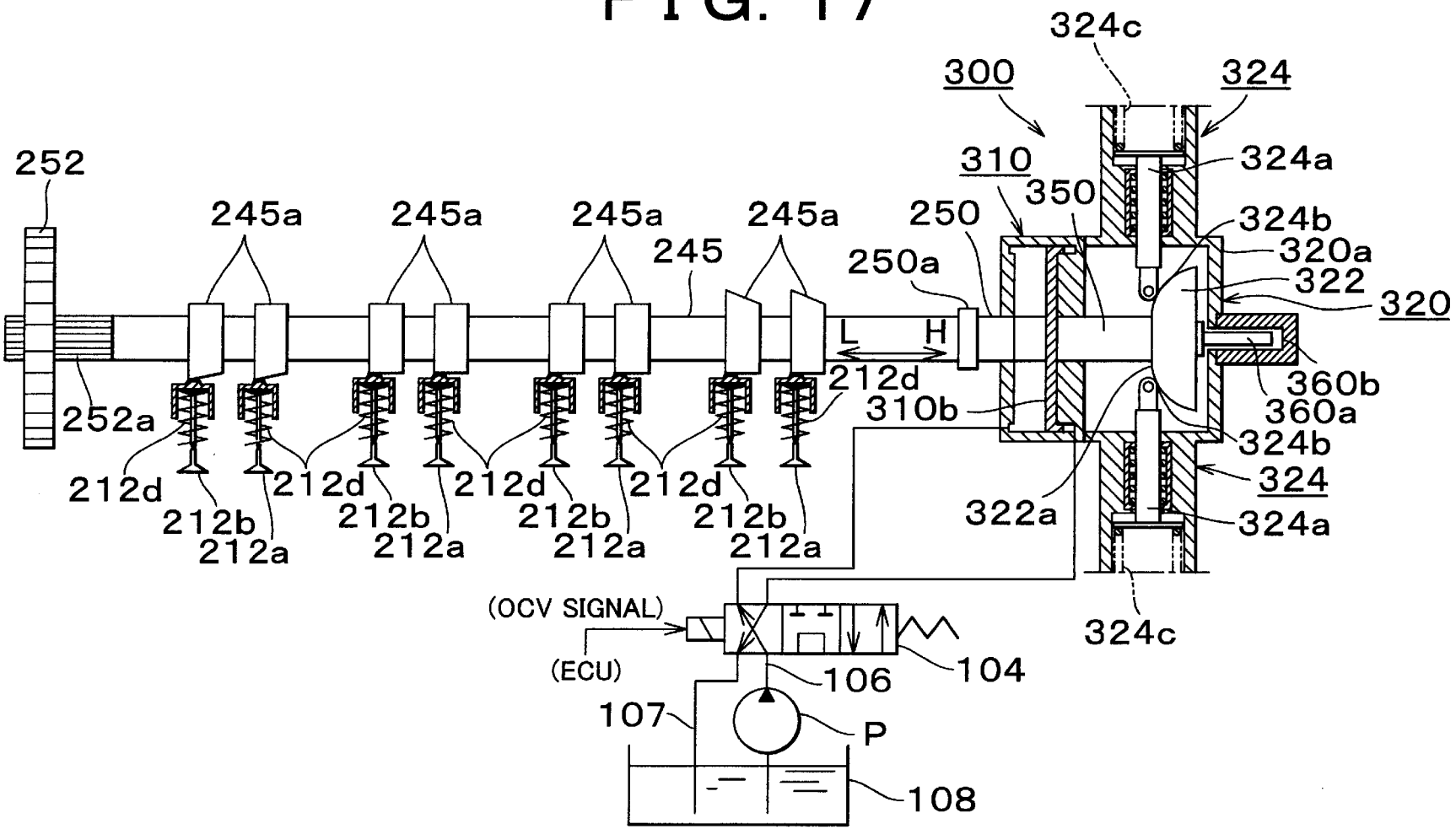
FIG. 17 is an explanatory view of the functions of the variable valve mechanism and the assisting device according to the second embodiment.

As shown in the drawings, the intake cams 245*a* designed as three-dimensional cams are designed such that their valve lift amounts are increased toward the left side. Thus, restoring forces received from the valve springs 212*d* of the intake valves 212*a*, 212*b* generate a thrust force applied to the intake cam shaft 245 in the direction L by means of the cam surfaces of the intake cams 245*a*. Hence, the cam surface 322*a* of the slide cam 322 is inclined in a curved manner and reversely with respect to the cam surfaces of the intake cams 245*a* and thus generates an assisting force that acts against the aforementioned thrust force. If the piston 310*b* exists at a critical position in the direction L as shown in FIG. 16, the aforementioned thrust force is small. Therefore, the roller 324*b* is in contact with the cam surface 322*a* of the slide cam 322 at a position with a slight inclination with respect to the axis of the intake cam shaft 245. If the piston 310*b* has been moved toward a critical position in the direction H, the restoring forces received from the valve springs 212*d* of the intake valves 212*a*, 212*b* are increased, and the thrust force is increased as well. Hence, the inclination of the cam surface 322*a* at a position for contacting the roller 324*b* is gradually increased, which causes an increase in the assisting force. If the piston 310*b* reaches the critical position in the direction H as shown in FIG. 17, the absolute values of the thrust force and the assisting force are maximized. The thrust force and the assisting force counterbalance each other as in the case of the aforementioned first embodiment shown in FIG. 8.

In the structure of the aforementioned second embodiment, the intake cam shaft 245 corresponds to a control shaft and the cam surface 322*a* of the slide cam 322 corresponds to a conversion plane.

The following effects are obtained from the second embodiment that has been described above.

(a) A force output by the output rod 324*a* is converted into an assisting force while the cam surface 322*a* of the slide cam 322 axially interlocked with the intake cam shaft 245 serves as a conversion plane. The force thus converted is applied to the intake cam shaft 245. Hence, as the intake cams 245*a* are moved by the intake cam shaft 245 in such a direction as to increase valve lift amounts, the assisting force can be correspondingly increased. Accordingly, a suitable assisting force that can act against a thrust force applied to the intake cam shaft 245 from the intake cams 245*a* can be applied to the intake cam shaft 245.

As a result, even if the pressure-receiving area of the piston 310*b* has been reduced for the sake of responding properties, there is no apprehension that a minimum hydraulic fluid pressure will not be ensured on the side with a large valve lift amount or that responding properties will deteriorate.

(b) The effects (b) and (c) of the aforementioned first embodiment also are obtained.

In the aforementioned embodiments, the urging force of the springs 103*c*, 324*c* is utilized to apply a pressing force for the roller 102*k* or the slide cam 322 to the output rods 103*a*, 324*a*. However, it is also appropriate that a pressing force be applied to the output rods 103*a*, 324*a* through a fluid pressure such as an oil pressure or an air pressure. In this case, almost no drop in pressure is caused even by movements of the control shaft 132 and the intake cam shaft 245. Therefore, a suitable assisting force that can be sufficient even for movements of the control shaft 132 and the intake cam shaft 245 over a more extensive range can be generated.

The slide actuator 300 of the second embodiment may be employed in the first embodiment instead of the slide actuator 100. Further, the slide actuator 100 of the first embodiment may be employed in the second embodiment instead of the slide actuator 300.

In the aforementioned embodiments, the number of the output rods 103*d*, 324*a* provided for the slide actuator 100, 300 is two. However, it is also appropriate that this number be one, or three or more. Further, it is not absolutely required that the single slide actuator 100 or 300 be provided for the control shaft 132 or the intake cam shaft 245. That is, two or more slide actuators may be axially coupled in series so as to strengthen an assisting force.

In the aforementioned embodiments, the output rods 103*a*, 324*a* protrude in the direction perpendicular to the axis of the control shaft 132 or the intake cam shaft 245. However, as shown in FIGS. 18, 19, even if the output rods 103*a*, 324*a* protrude in a direction that is not perpendicular to the axis but parallel to a virtual plane (PY, QY) perpendicular to the axis, an assisting force can be generated.

Figure 18:
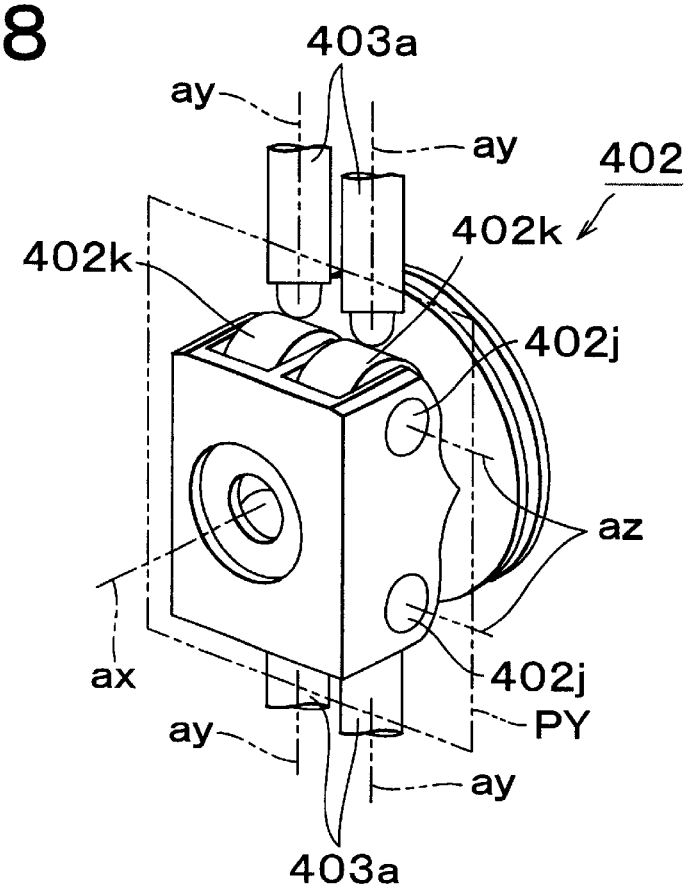
FIG. 18 is an explanatory view of the structure of a modified example of the first embodiment.

FIG. 18 shows a modified example of the first embodiment. In FIG. 18, each of two shaft portions 402J disposed parallel to a piston body 402 is provided with a corresponding pair of rollers 402*k*. Axes "az" of the rollers 402*k* are parallel to a virtual plane (PY) that is perpendicular to an axis "ax" of a control shaft. Output rods 403*a* having axes "ay" protrude parallel to the virtual plane (PY) in such a manner as to be in contact with outer peripheral surfaces of the rollers 402*k*. Even in such a structure, the four rollers 402*k* receive pressing forces output by the four output rods 403*a*, whereby the pressing forces are converted into assisting forces acting in the direction of an axis "ax" of the control shaft on the outer peripheral surfaces of the rollers 402*k*. Thus, even if a large thrust force is generated in the intermediary drive mechanism, those assisting forces can act against the thrust force.

Figure 19:
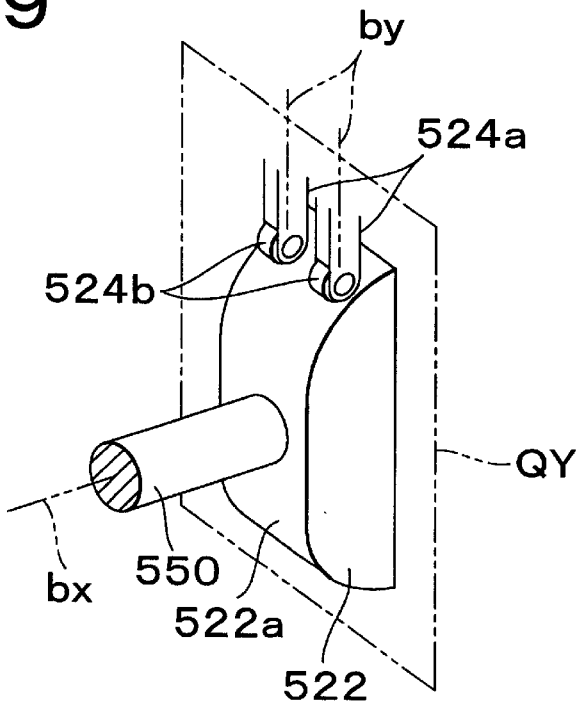
FIG. 19 is an explanatory view of the structure of a modified example of the second embodiment.

FIG. 19 shows a modified example of the second embodiment. Although the slide cam 322 of the second embodiment assumes a generally hemispherical shape, a slide cam 522 of this modified example assumes a generally semicolumnar shape. A coupling shaft 550 is fitted to the center of an outer peripheral surface of the slide cam 522. Output rods 524*a* having axes "by" protrude parallel to a virtual plane (QY) perpendicular to an axis "bx" in such a manner as to be in contact with a cam surface 522*a* constructed of the outer peripheral surface. Rollers 524*b* are provided on the ends of the rods 524*a*. Even in such a structure, the cam surface 522*a* receives pressing forces output by the four output rods 524*a* (the lower two are not shown), whereby the pressing forces are converted into assisting forces acting in the direction of the axis "bx" of the coupling shaft 550. Thus, even if a large thrust force is generated, those assisting forces can act against the thrust force.

In the aforementioned first embodiment (FIG. 3), the rollers 102*k* are disposed on the side of the piston portion 102*a*. However, it is also appropriate that each of the rollers 102*k* be disposed at the leading end of a corresponding one of the output rods 103*a* and that a protrusion identical in shape to the leading end portions 103*d* of the output rods 103 (or a salient strip identical in cross-sectional shape to the leading end portions 103*d* of the output rods 103) be formed on the side of the piston portion 102*a*. In this case, the same function as in the first embodiment can be substantially achieved. In the second embodiment (FIG. 16) as well, it is appropriate that the roller 324*b* be disposed on the side of the coupling shaft 350 and that a cam having a generally cylindrical surface identical in shape to the cam surface 322*a* of the slide cam 322 be disposed on the side of the output rod 324*a*. In this case, the same function as in the second embodiment can be substantially achieved. As for the examples described with reference to FIGS. 18 and 19 as well, the structure in which the rollers are disposed at the leading ends of the output rods and the structure in which the rollers are disposed on the side of the control shaft or the coupling shaft may be interchanged. In this case as well, the same function as described above can be substantially achieved.

As described above, an embodiment according to one aspect of the invention is designed such that the assisting force applying portion increases the assisting force as the axial position of the control shaft is shifted to the high-lift side. Hence, a suitable assisting force capable of acting against a thrust force that is increased as the axial position of the control shaft is shifted to the high-lift side can be applied to the variable valve mechanism. Since the assisting force is generated on the basis of a restoring force of the elastic body or a pressure of the fluid, it is not weakened all of a sudden as in the case of a magnetic force. That is, an assisting force that is sufficient even for axial movements of the control shaft over an extensive range can be generated.

As a result, the apprehension that a minimum hydraulic fluid pressure will not be ensured on the side of a larger valve lift amount or that responding properties will deteriorate can be eliminated.

The assisting device of the aforementioned variable valve mechanism can be characterized as follows. The assisting force applying portion includes the assisting force output portion and the conversion plane. The assisting force output portion outputs a restoring force of an elastic body or a pressure of a fluid parallel to the virtual plane intersecting with the axis of the control shaft. The conversion plane receives a force output from the assisting force output portion, converts it into a force acting in the direction of the axis of the control shaft, and makes it available as an assisting force. The assisting force applying portion changes the inclination of the conversion plane at a position to which a force from the assisting force output portion is transmitted, in such a manner as to interlock with axial movements of the control shaft. Thus, as the axial position of the control shaft is shifted to the high-lift side, the assisting force can be correspondingly increased.

Since the aforementioned conversion plane is provided, the force output by the assisting force output portion is converted into a force acting in the direction of the axis of the control shaft. The inclination of the conversion plane to which the force is transmitted changes while interlocking with axial movements of the control shaft, whereby the assisting force is increased in proportion to a shift to the high-lift side. Therefore, a suitable assisting force that can act against the aforementioned thrust force can be applied to the variable valve mechanism.

In the embodiment according to one aspect of the invention, the output rod transmits a force by means of the conversion plane.

The output thus constructed makes it possible to easily transmit a force to the conversion plane and adjust the magnitude of an assisting force through an inclination of the conversion plane. Thus, a suitable assisting force that can act against a thrust force can be applied to the variable valve mechanism.

Furthermore, in the embodiment according to one aspect of the invention, the conversion plane is designed as a cam surface and a cam having the cam surface is designed to be moved in the direction of the axis of the control shaft, whereby the assisting force can be easily increased by means of a restoring force of the elastic body or a pressure of the fluid as the axial position of the control shaft is shifted to the high-lift side. Thus, a suitable assisting force that can act against a thrust force can be applied to the variable valve mechanism.

In addition, in the embodiment according to one aspect of the invention, the conversion plane is designed as an outer peripheral surface of a ring and the position of the output rod for contacting the outer peripheral surface is axially moved in such a manner as to interlock with the control shaft, whereby the assisting force can be easily increased by means of a restoring force of the elastic body or a pressure of the fluid as the axial position of the control shaft is shifted to the high-lift side. Thus, a suitable assisting force that can act against a thrust force can be applied to the variable valve mechanism.

Instead of the structure of the aforementioned embodiments in which the output rods protrude in the direction substantially perpendicular to the axis of the control shaft, it is also appropriate that the output rods be in contact with the conversion plane by protruding parallel to the virtual plane that is substantially perpendicular to the axis of the control shaft as described above. This also makes it possible to easily increase the assisting force by means of a restoring force of the elastic body or a pressure of the fluid as the axial position of the control shaft is shifted to the high-lift side. Thus, a suitable assisting force that can act against a thrust force can be applied to the variable valve mechanism.

The variable valve mechanism may also include the cam shaft, the cams, the intermediary drive mechanism, the control shaft, and the actuator. In such a structure as well, the structure of the aforementioned assisting force applying portion makes it possible to easily increase the assisting force by means of a restoring force of the elastic body or a pressure of the fluid as the axial position of the control shaft is shifted to the high-lift side. Thus, a suitable assisting force that can act against a thrust force can be applied to the variable valve mechanism.

The variable valve mechanism may also include the three-dimensional cams and the control shaft. Even in such a structure, the structure of the aforementioned assisting force applying portion makes it possible to easily increase the assisting force by means of a restoring force of the elastic body or a pressure of the fluid as the axial position of the control shaft is shifted to the high-lift side. Thus, a suitable assisting force that can act against a thrust force can be applied to the variable valve mechanism.

Further, it is also appropriate that the control shaft be used as the cam shaft having the three-dimensional cams as well. In this case as well, a suitable assisting force that can act against a thrust force can be applied to the variable valve mechanism.

As in the case of the aforementioned embodiments, the assisting device generates an assisting force by means of a restoring force of the spring. Thus, the spring can be used as the elastic body. Accordingly, since the assisting force can be easily increased by means of the restoring force of the spring as the axial position of the control shaft is shifted to the highlift side, a suitable assisting force that can act against the thrust force can be applied to the variable valve mechanism with a relatively simple structure.

Further, the assisting device can use oil as a fluid for generating an assisting force. Accordingly, the assisting force can be easily increased by means of a hydraulic pressure as the axial position of the control shaft is shifted to the high-lift side. Thus, a suitable assisting force that can act against the thrust force can be applied to the variable valve mechanism.

Furthermore, as in the case of the aforementioned embodiments, the variable valve mechanism makes it possible to continuously change valve lift amounts of the intake valves of the internal combustion engine.

By applying the aforementioned assisting device to the variable valve mechanism for adjusting valve lift amounts of the intake valves of the internal combustion engine, it becomes possible to apply a suitable assisting force to the variable valve mechanism and to adjust the amount of intake air in the internal combustion engine with a quick response.

While the invention has been described with reference to preferred exemplary embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more less or only a single element, are also within the spirit and scope of the invention.

What is claimed is:

1. An assisting device for applying an assisting force to counteract a thrust force generated in a variable valve mechanism, comprising:

valves disposed in the variable valve mechanism;

a control shaft that is movable to cause valve lift amounts of the valves to continuously change with changes in an axial position of the control shaft, the control shaft receiving the thrust force from the valves;

a force applying member coupled to the control shaft and that receives an adjusting force from a first source of force to adjust the axial position of the control shaft; and an assisting force applying portion that generates and applies the assisting force to the control shaft on the basis of a restoring force of an elastic body or a pressure of a fluid, which is a second source of force that is in addition to the first source of force, the assisting force applying portion increasing the assisting force as the axial position of the control shaft is shifted to a high-lift side.

2. An assisting device for applying an assisting force to counteract a thrust force generated in a variable valve mechanism, comprising:

valves disposed in the variable valve mechanism;

a control shaft that is movable to cause valve lift amounts of the valves to continuously change with changes in an axial position of the control shaft, the control shaft receiving the thrust force from the valves; and an assisting force applying portion that generates and applies the assisting force to the control shaft on the basis of a restoring force of an elastic body or a pressure of a fluid, the assisting force applying portion increasing the assisting force as the axial position of the control shaft is shifted to a high-lift side, wherein the assisting force applying portion comprises:

an assisting force output portion that outputs the restoring force of the elastic body or the pressure of the fluid parallel to a virtual plane perpendicular to an axis of the control shaft, and a conversion plane that converts a force output from the assisting force output portion into a force acting in a direction of the axis of the control shaft so as to use the force as the assisting force, and changes an inclination of the conversion plane at a position to which the force from the assisting force output portion is converted as the control shaft moves axially so as to increase the assisting force as the axial position of the control shaft is shifted to the high-lift side.

3. The assisting device according to claim 2, wherein:

the assisting force output portion comprises an output rod protruding toward the conversion plane due to the restoring force of the elastic body or a pressure of the fluid; and the force from the output rod is transmitted to the conversion plane through contact of the output rod with the conversion plane.

4. The assisting device according to claim 3, wherein:

the smaller an angle of the output rod with respect to an abutment surface between the output rod and the conversion plane becomes, the larger the force transmitted to the control shaft becomes; and the closer to a right angle the angle of the output rod with respect to the abutment surface between the output rod and the conversion plane becomes, the smaller the assisting force transmitted to the control shaft becomes.

5. The assisting device according to claim 4, wherein:

the output rod protrudes in a direction substantially perpendicular to the axis of the control shaft;

the conversion plane is formed as a cam surface on a cam moving in a direction of the axis of the control shaft while interlocking with the control shaft; and a position of the output rod that contacts the cam surface is axially moved as the control shaft axially moves, whereby the assisting force is increased as the axial position of the control shaft is shifted to the high-lift side.

6. The assisting device according to claim 4, wherein:

the output rod protrudes in a direction substantially perpendicular to the axis of the control shaft;

the conversion plane is formed as an outer peripheral surface of a ring that moves in the direction of the axis of the control shaft as the control shaft axially moves, with an axis parallel to the virtual plane substantially perpendicular to the axis of the control shaft serving as an axis of rotation; and a position of the output rod that contacts the outer peripheral surface is moved in the direction of the axis of the control shaft as the control shaft axially moves, whereby the assisting force is increased as the axial position of the control shaft is shifted toward the high-lift side.

7. The assisting device according to claim 4, wherein:

the output rod protrudes parallel to the virtual plane substantially perpendicular to the axis of the control shaft;

the conversion plane is formed as an outer peripheral surface of a ring that moves in the direction of the axis of the control shaft as the control shaft axially moves, with an axis parallel to the virtual plane substantially perpendicular to the axis of the control shaft serving as an axis of rotation; and a position of the output rod that contacts the outer peripheral surface is moved in the direction of the axis of the control shaft as the control shaft axially moves, whereby the assisting force is increased as the axial position of the control shaft is shifted toward the high-lift side.

8. The assisting device according to claim 1, wherein the variable valve mechanism comprises:

a cam shaft that is rotationally driven by a crank shaft of an internal combustion engine;

cams disposed on the cam shaft;

intermediary drive mechanisms each of which is pivotally supported by a shaft other than the cam shaft and each of which has a shaft input portion and a shaft output portion so that a corresponding one of the valves is driven at the output portion in response to the driving of the input portion by a corresponding one of the cams;

the control shaft whose axial moving distance is based on a difference in phase between the input portion and the output portion of each of the intermediary drive mechanisms; and an actuator for axially moving the control shaft and thus adjusting the difference in phase between the shaft input portion and the shaft output portion of each of the intermediary drive mechanisms, and thus allows valve lift amounts to continuously change with changes in the axial position of the control shaft.

9. The assisting device according to claim 1, wherein:

the variable valve mechanism is a mechanism that allows valve lift amounts to continuously change by axially moving three-dimensional cams whose cam profile changes in the axial direction; and an axial moving distance of the control shaft changes with an axial moving distance of the three-dimensional cams.

10. The assisting device according to claim 9, wherein the control shaft also serves as a cam shaft for the three-dimensional cams.

11. The assisting device according to claim 1, wherein the assisting force applying portion generates the assisting force on the basis of a restoring force of a spring.

12. The assisting device according to claim 1, wherein the assisting force applying portion generates the assisting force on the basis of a hydraulic pressure.

13. The assisting device according to claim 1, wherein the variable valve mechanism allows valve lift amounts of intake valves of an internal combustion engine to continuously change.

14. An assisting method for applying an assisting force to counteract a thrust force generated in a variable valve mechanism, comprising the steps of:

allowing valve lift amounts of valves disposed in the variable valve mechanism to continuously change with changes in an axial position of a control shaft;

adjusting the axial position of the control shaft by applying an adjusting force to a force applying member that is coupled to the control shaft, the adjusting force is supplied from a first source of force; and increasing the assisting force that is applied to the control shaft on the basis of a restoring force of an elastic body or a pressure of a fluid as the axial position of the control shaft that receives the thrust force is shifted to a high-lift side, the elastic body that supplies the restoring force or the fluid that supplies the pressure being a second source of force that is in addition to the first source of force.

15. An assisting method for applying an assisting force to counteract a thrust force generated in a variable valve mechanism, comprising the steps of:

allowing valve lift amounts of valves disposed in the variable valve mechanism to continuously change with changes in an axial position of a control shaft; and increasing the assisting force that is applied to the control shaft on the basis of a restoring force of an elastic body or a pressure of a fluid as the axial position of the control shaft that receives the thrust force is shifted to a high-lift side, wherein:

the restoring force of the elastic body or the pressure of the fluid is output to a virtual plane that intersects with an axis of the control shaft;

the force output to the virtual plane is converted by a conversion plane into a force acting in a direction of the axis of the control shaft as the assisting force; and an inclination of the conversion plane at a position to which the force is transmitted to the conversion plane is changed with changes in axial movement of the control shaft, whereby the assisting force is increased as the axial position of the control shaft is shifted to the high-lift side.

16. The assisting method according to claim 14, wherein the force applying member includes a piston, and the first source of force is a source of hydraulic force that applies pressure to the piston.

17. The assisting device according to claim 1, wherein the force applying member includes a piston, and the first source of force is a source of hydraulic force that applies pressure to the piston.

18. The assisting device according to claim 2, wherein the variable valve mechanism comprises:

a cam shaft that is rotationally driven by a crank shaft of an internal combustion engine;

cams disposed on the cam shaft;

intermediary drive mechanisms each of which is pivotally supported by a shaft other than the cam shaft and each of which has a shaft input portion and a shaft output portion so that a corresponding one of the valves is driven at the output portion in response to the driving of the input portion by a corresponding one of the cams;

the control shaft whose axial moving distance is based on a difference in phase between the input portion and the output portion of each of the intermediary drive mechanisms; and an actuator for axially moving the control shaft and thus adjusting the difference in phase between the shaft input portion and the shaft output portion of each of the intermediary drive mechanisms, and thus allows valve lift amounts to continuously change with changes in the axial position of the control shaft.

19. The assisting device according to claim 2, wherein:

the variable valve mechanism is a mechanism that allows valve lift amounts to continuously change by axially moving three-dimensional cams whose cam profile changes in the axial direction; and an axial moving distance of the control shaft changes with an axial moving distance of the three-dimensional cams.

20. The assisting device according to claim 19, wherein the control shaft also serves as a cam shaft for the three-dimensional cams.

21. The assisting device according to claim 2, wherein the assisting force applying portion generates the assisting force on the basis of a restoring force of a spring.

22. The assisting device according to claim 2, wherein the assisting force applying portion generates the assisting force on the basis of a hydraulic pressure.

23. The assisting device according to claim 2, wherein the variable valve mechanism allows valve lift amounts of intake valves of an internal combustion engine to continuously change.

* * * * *